US006742800B2

(12) United States Patent
Okajima

(10) Patent No.: US 6,742,800 B2
(45) **Date of Patent: *Jun. 1, 2004**

(54) SNOWBOARD BINDING SYSTEM

(75) Inventor: Shinpei Okajima, Izumi (JP)

(73) Assignee: Shimano, Inc., Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/836,545

(22) Filed: Apr. 18, 2001

(65) Prior Publication Data

US 2002/0153698 A1 Oct. 24, 2002

(51) Int. Cl.[7] ..... A63C 9/00; A63C 9/10

(52) U.S. Cl. ..... 280/613; 280/624; 280/11.31

(58) Field of Search ..... 280/613, 14.22, 280/14.24, 14.21, 618, 617, 624, 625; 36/115, 117.1, 117.3

(56) References Cited

U.S. PATENT DOCUMENTS

| | | | | | |
|---|---|---|---|---|---|
| 2,145,102 | A | * | 1/1939 | Spini | 36/117.5 |
| 3,061,325 | A | * | 10/1962 | Glass | 280/613 |
| 4,177,584 | A | * | 12/1979 | Beyl | 280/613 |
| 4,352,508 | A | * | 10/1982 | Spademan | 280/624 |
| 4,973,073 | A | * | 11/1990 | Raines et al. | 280/14.22 |
| 5,069,463 | A | * | 12/1991 | Baud et al. | 280/14.23 |
| 5,505,478 | A | * | 4/1996 | Napoliello | 280/14.22 |
| 5,544,909 | A | * | 8/1996 | Laughlin et al. | 280/14.23 |
| 5,564,719 | A | * | 10/1996 | Kisselmann | 280/14.23 |
| 5,690,351 | A | * | 11/1997 | Karol | 280/618 |
| 5,704,139 | A | | 1/1998 | Okajima | |
| 5,722,680 | A | | 3/1998 | Dodge | |
| 5,915,720 | A | * | 6/1999 | Turner et al. | 280/14.22 |
| 5,954,358 | A | * | 9/1999 | Bejean et al. | 280/14.24 |
| 6,050,589 | A | * | 4/2000 | Couderc et al. | 280/14.21 |
| 6,099,018 | A | | 8/2000 | Maravetz et al. | |
| 6,123,354 | A | | 9/2000 | Laughlin et al. | |
| 6,126,179 | A | * | 10/2000 | Dodge | 280/14.22 |
| 6,164,682 | A | | 12/2000 | Okajima et al. | |
| 6,168,173 | B1 | * | 1/2001 | Reuss et al. | 280/14.22 |
| 6,189,913 | B1 | * | 2/2001 | Morrow et al. | 280/14.21 |
| 6,193,245 | B1 | * | 2/2001 | Vensel | 280/11.3 |
| 6,209,890 | B1 | * | 4/2001 | Couderc | 280/14.22 |
| 6,213,493 | B1 | * | 4/2001 | Korman | 280/14.22 |
| 6,276,708 | B1 | * | 8/2001 | Hogstedt | 280/14.22 |
| 6,293,578 | B1 | * | 9/2001 | Anderson et al. | 280/14.24 |
| 6,302,428 | B1 | * | 10/2001 | Jungkind | 280/14.22 |

FOREIGN PATENT DOCUMENTS

FR 2767486 A1 * 2/1999

OTHER PUBLICATIONS

U.S. 2002/0153705 A1 to Okajima et al.*

* cited by examiner

*Primary Examiner*—Matthew C. Graham
*Assistant Examiner*—Melody M. Burch
(74) *Attorney, Agent, or Firm*—Shinjyu Global IP Counselors, LLP

(57) ABSTRACT

A snowboard binding system is provided that is relatively easy to step-in and step-out of. The snowboard binding has a base member, a front binding member movably coupled the base member between a release position and a latched position, and a pair of rear binding members coupled to lateral sides of the base member. The rear binding members have latch members movable relative to the base member to selectively hold the rear catch portions of a snowboard boot. The latch members are arranged to move laterally apart relative to each other upon application of a force direction substantially towards the base member. The first and second latch members are arranged to selectively hold the catch members in a plurality of engagement positions having different heights above the base member.

43 Claims, 14 Drawing Sheets

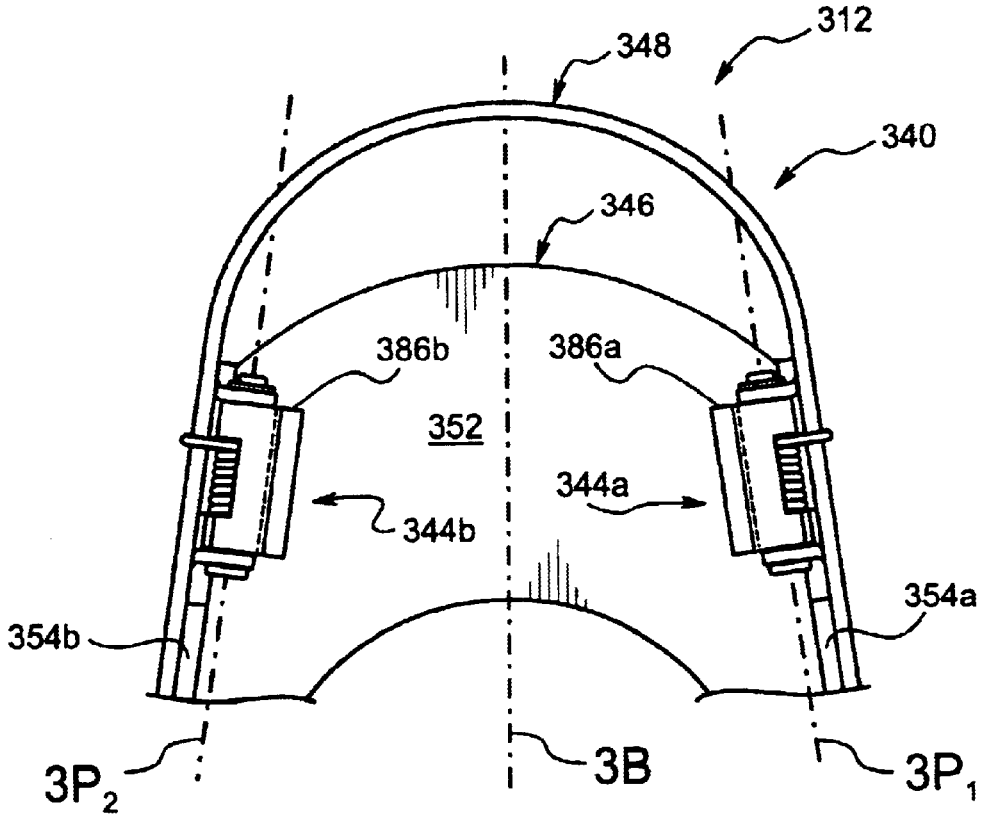
FIG. 19
FIG. 20
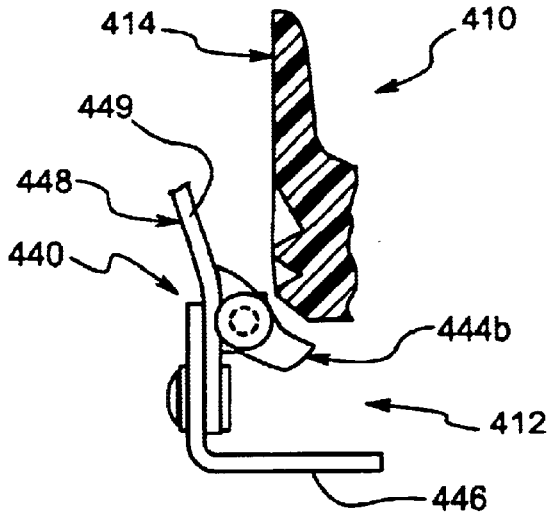

SNOWBOARD BINDING SYSTEM

BACKGROUND OF THE INVENTION

The present invention generally relates to a snowboard binding system for releasably coupling a snowboard boot to a snowboard. More specifically, the present invention relates to a snowboard binding that is easy to step-in and step-out of even when snow builds up between the snowboard binding and the sole portion of the snowboard boot.

BACKGROUND INFORMATION

In recent years, snowboarding has become a very popular winter sport. In fact, snowboarding was also an Olympic event during the winter games at Nagano, Japan. Snowboarding is similar to skiing in that a rider rides down a snow covered hill. The snowboard is generally shaped as a small surfboard or a large skateboard without wheels. The snowboarder stands on the snowboard with his or her feet generally transverse to the longitudinal axis of the snowboard. Similar to skiing, the snowboarder wears special boots, which are fixedly secured to the snowboard by a binding mechanism. In other words, unlike skiing, the snowboarder has both feet securely attached to a single snowboard with one foot positioned in front of the other foot. The snowboarder stands with both feet on the snowboard in a direction generally transverse to the longitudinal axis of the snowboard. Moreover, unlike skiing, the snowboarder does not utilize poles.

Snowboarding is a sport that involves balance and control of movement. When steering on a downhill slope, the snowboarder leans in various directions in order to control the direction of the movement of the snowboard. Specifically, as the snowboarder leans, his or her movements must be transmitted from the boots worn by the rider to the snowboard in order to maintain control of the snowboard. For example, when a snowboarder leans backward, the movement causes the snowboard to tilt accordingly turning in the direction of the lean. Similarly, leaning forward causes the board to tilt in a corresponding manner and thus causing the snowboard to turn in that direction.

Generally, the snowboarding sport may be divided into alpine and freestyle snowboarding. In alpine snowboarding, hard boots similar to those conventionally used for alpine skiing are worn, and fitted into so-called hard bindings mounted on the snowboard, which resemble alpine ski boot bindings. In freestyle snowboarding, soft boots similar to ordinary boots, or adaptations of boots such as hard shell alpine boots are typically worn, fitted into so-called soft bindings.

Boots that are used for, for instance, skiing and/or snowboarding must have a high degree of rigidity for effecting steering while skiing and snowboarding. In particular, when snowboarding it is important that the rider be able to lean to the side, backward and forward with respect to the snowboard. The motion corresponding to the direction of the lean of the rider is transmitted through the boots to the snowboard (or skis) to effect turning or braking. Therefore, it is extremely important that the boots worn by the rider have sufficient rigidity to transfer such leaning motion to the snowboard or skis.

In particular, the back side of a snowboard boot must be rigid in order to provide the appropriate support for controlling movement of the snowboard. Further, as the art of snowboarding has developed, riders have found that snowboard boots provide optimal support when the back side of the snowboard boots are inclined slightly, such that the knees of the rider are always slightly bent when wearing the boots on level ground. Therefore, standing up straight with knees straight when wearing inclined snowboard boots is not always comfortable. Further, walking in such snowboard boots is sometimes awkward.

Recently, snowboard boots have been developed which allow a rider to adjust and change the inclination of inclined backside snowboard boots. For example, there are snowboard boots which include a member known as a highback support that is secured to the snowboard boot by pins which allow the highback support to pivot about the pins. The highback support extends up the back side of the boot and when locked into position fixes the back side of the boot into a predetermined inclined position that is optimal for snowboarding. When unlocked, the highback support can pivot back and allow the rider wearing the boot to stand up straight and walk more freely without having to keep the knees bent. A simple bar is used with such a boot for locking the highback support in place. Typically, the bar braces the highback support into position. An upper end of the bar is fixed to an upper portion of the highback support by a pivot pin. A lower end of the bar is configured to fit into a hook formed in a lower portion of the boot. When a rider is wearing the boots, the rider must lean forward in order to fit the bar into and out of position. The lean forward requires a significant amount of effort due to the overall rigidity of the snowboard boots and therefore the bar configuration, especially in the snow and cold, can be difficult for some riders to release and/or engage.

Accordingly, a snowboarder may want to change the binding orientation depending on the style of snowboarding, the snowboarder level of skill and/or rider preferences. Moreover, snowboarders typically ride with their left foot in front of the right foot on the snowboard. However, some snowboarders want to ride with their right foot in front of the left foot on the snowboard (so-called goofy style). In order to accommodate the different styles of snowboarding, the snowboarder level of skill and/or the snowboarder preferences, the bindings have been made to be adjustable so that the snowboarder can adjust the angle of his feet relative to the longitudinal axis of the snowboard. In the past, changing the angle of the snowboarder's stance required the snowboarder to loosen several mounting screws so that the binding may be rotated relative to the snowboard, and then re-tightening the screws. This type of binding is very time consuming in order to change the snowboarder's stance. Moreover, a tool must be used to adjust the snowboarder's stance.

Additionally, in recent years, snowboard bindings have been designed that securely lock to the snowboard boots, but can be released by the snowboarder after riding. Sometimes these bindings are difficult to engage due to buildup of snow and or cold. Moreover, these bindings can be difficult to release the snowboarder's boots. Furthermore, these bindings can be uncomfortable when riding the snowboard due to continued shock between the snowboard boots and the bindings.

In view of the above, there exists a need for a snowboard binding which overcomes the above mentioned problems in the prior art. This invention addresses this need in the prior art as well as other needs, which will become apparent to those skilled in the art from this disclosure.

SUMMARY OF THE INVENTION

One object of the present invention is to provide a snowboard binding that is relatively easy to step-in and step-out of.

Another object of the present invention is to provide a snowboard binding that has at least two height adjustment positions for accommodating snow between the snowboard binding and the sole of the snowboard boot.

Yet another object of the present invention is to provide a snowboard binding which eliminates the rear binding beneath the sole of the snowboard boot.

Still another object of the present invention is to provide a snowboard binding that is relatively simple and inexpensive to manufacture and assemble.

Still another object of the present invention is to provide a snowboard binding that is relatively lightweight.

Yet still another object of the present invention is to provide a snowboard binding, which reduces shock and improves power transfer between the sole of the snowboard boot and the snowboard binding.

In accordance with one aspect of the present invention, a snowboard binding is provided that comprises a base member and a rear binding member. The base member has a front portion, a rear portion and a longitudinal axis extending between the front and rear portions. The rear binding member is coupled to a first lateral side of the rear portion of the base member. The rear binding member includes a first latch member movable relative to the base member. The first latch member is pivotally supported about a first pivot axis substantially parallel to the longitudinal axis. The first latch member is arranged to move laterally upon application of a force in a direction substantially towards the base member.

In accordance with another aspect of the present invention, a snowboard binding system is provided that comprises a snowboard boot and a snowboard binding. The snowboard boot has a sole portion, a front catch portion located at a front part of the sole portion, a first rear catch portion and a second rear catch portion. The first rear catch portion is located at a first lateral side of the sole portion and the second rear catch portion is located at a second lateral side of the sole portion. The snowboard binding basically includes a base member, a front binding member, a first rear binding member and a second rear binding member. The base member has a front portion, a rear portion and a longitudinal axis extending between the front and rear portions. The front binding member is movably coupled to the front portion of the base member between a release position and a latched position. The first rear binding member is coupled to a first lateral side of the rear portion of the base member. The first rear binding member includes a first latch member movable relative to the base member to selectively hold the first rear catch portion of the snowboard boot. The first latch member is arranged to move upon application of a force in a direction substantially towards the base member. The second rear binding member is coupled to a second lateral side of the rear portion of the base member. The second rear binding member includes a second latch member movable relative to the base member to selectively hold the second rear catch portion of the snowboard boot. The first and second latch members are arranged to move laterally apart relative to each other upon application of a force in the direction substantially towards the base member.

In accordance with another aspect of the present invention, a snowboard boot is provided that comprises an upper portion and a sole portion coupled to the upper portion. The sole portion has a first rear catch portion located at a first lateral side of the sole portion and a second rear catch portion located at a second lateral side of the sole portion. The first rear catch portion includes at least one first notch and the second rear catch portion includes at least one second notch.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure:

FIG. 19 is a diagrammatic, top plan view of a portion of a snowboard binding in accordance with a third embodiment of the present invention; and FIG. 20 is a diagrammatic, partial cross-sectional view of a portion of a snowboard binding system in accordance with a fourth embodiment of the present invention.

DETAILED DESCRIPTION OF THE PREFERRED EMBODIMENTS

Figure 1:
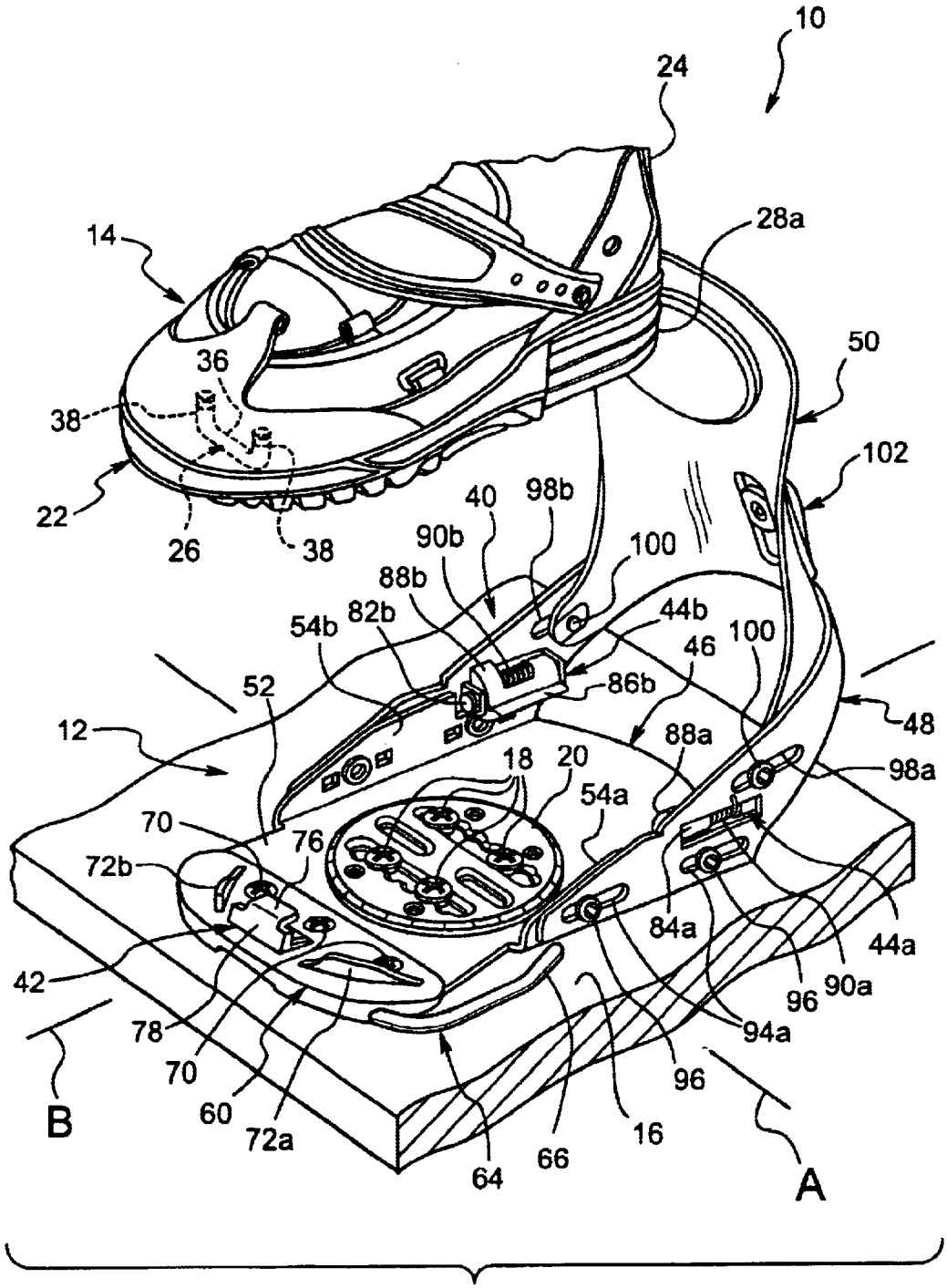
FIG. 1 is a perspective view of a snowboard binding system having a snowboard binding fixed to a snowboard and a snowboard boot in accordance with a first embodiment of the present invention.
Figure 2:
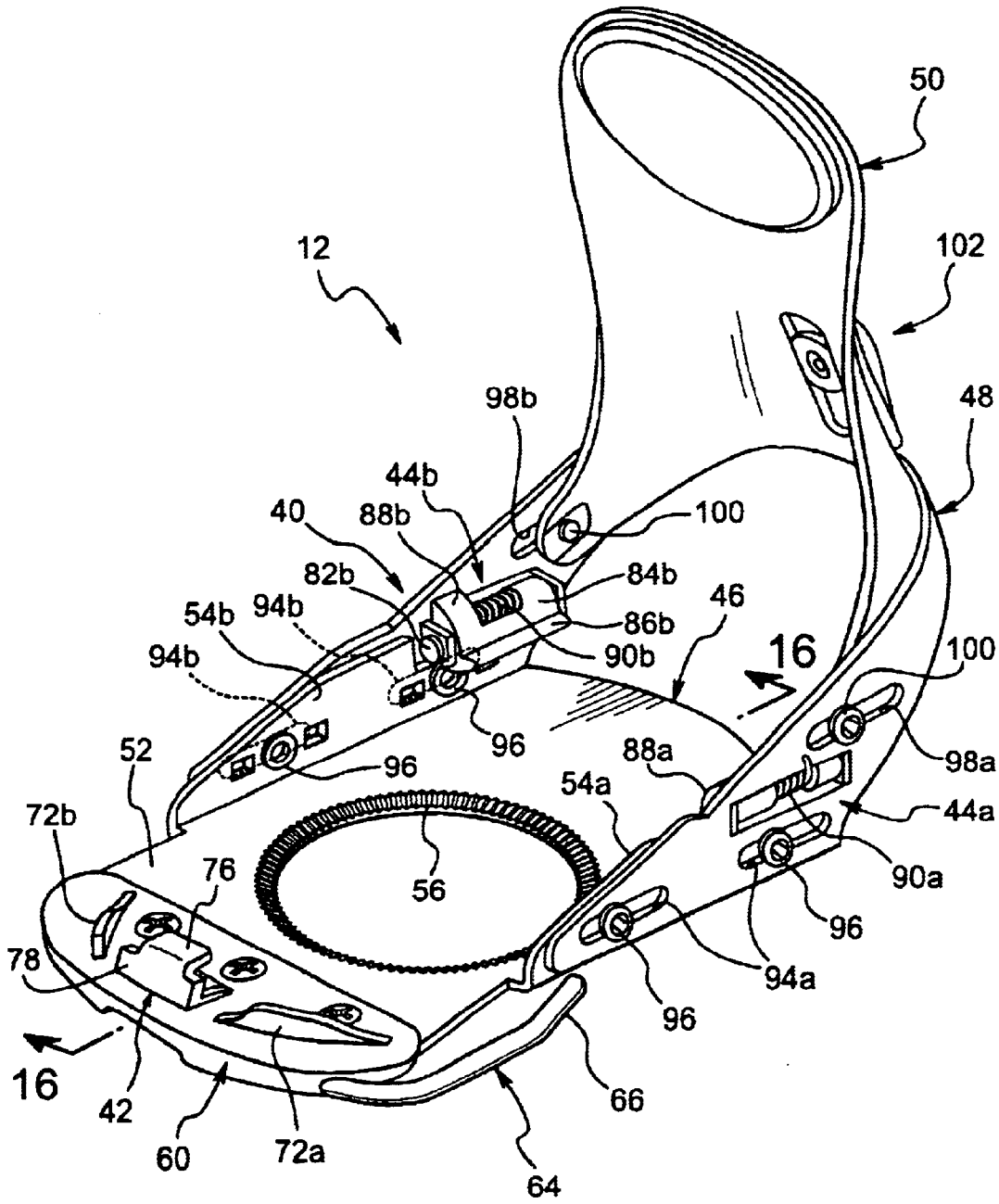
FIG. 2 is an enlarged perspective view of the snowboard binding illustrated in FIG. 1 with the snowboard binding removed from the snowboard.

Referring initially to FIGS. 1 and 2, a snowboard binding system 10 is illustrated in accordance with a preferred embodiment of the present invention. The snowboard binding system 10 basically includes a snowboard binding 12 and a snowboard boot 14. The snowboard binding 12 is attached to the top or upper surface of the snowboard 16 via four fasteners or screws 18 in a conventional manner. The longitudinal axis of the snowboard 16 is represented by centerline A in FIG. 1. It will be apparent to those skilled in the art from this disclosure that a pair of snowboard binding systems 10 are utilized in conjunction with the snowboard 16 such that the rider has both feet firmly attached to the snowboard 16. Preferably, a pair of adjustment disks 20 are used to adjustably couple the pair of snowboard binding systems 10 to the snowboard 16 via the screws 18. For the sake of brevity, only a single snowboard binding system 10 will be discussed and/or illustrated herein.

The snowboard boot 14 of the present invention is preferably a relatively soft or flexible snowboard boot. Soft snowboard boots are well known in the art, and thus, will not be discussed or illustrated herein. The snowboard boot 14 will not be discussed or illustrated in detail herein, except as the snowboard boot 14 relates to snowboard binding system 10 of the present invention. Basically, soft snowboard boots have a sole portion made of a stiff rubber-like material, and a flexible upper portion constructed of a variety of materials, such as plastic materials, leather and/or synthetic leather materials. Thus, the upper portion of a soft snowboard boot should be somewhat flexible.

Figure 3:
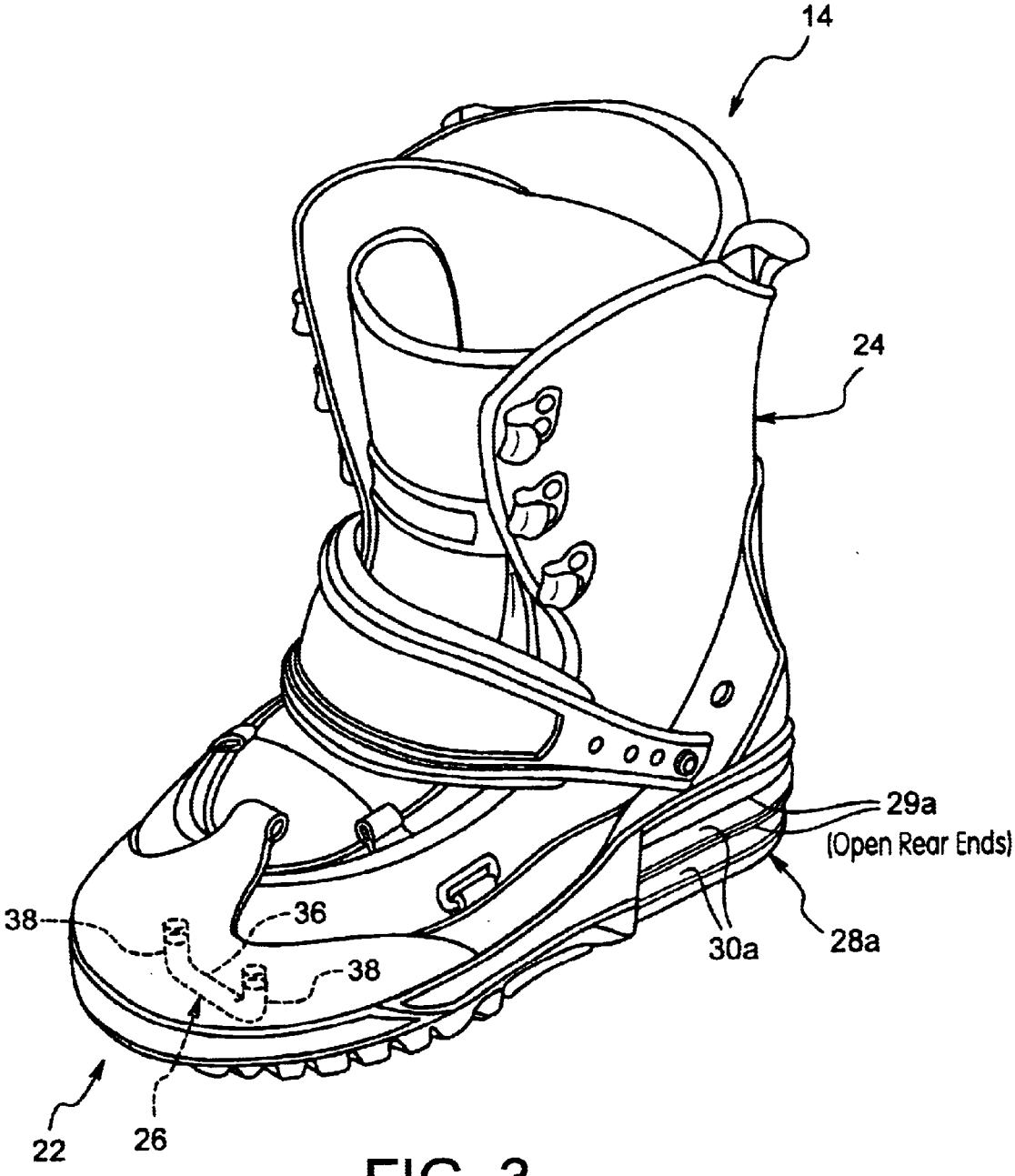
FIG. 3 is an enlarged, top perspective view of the entire snowboard boot illustrated in FIG. 1.
Figure 4:
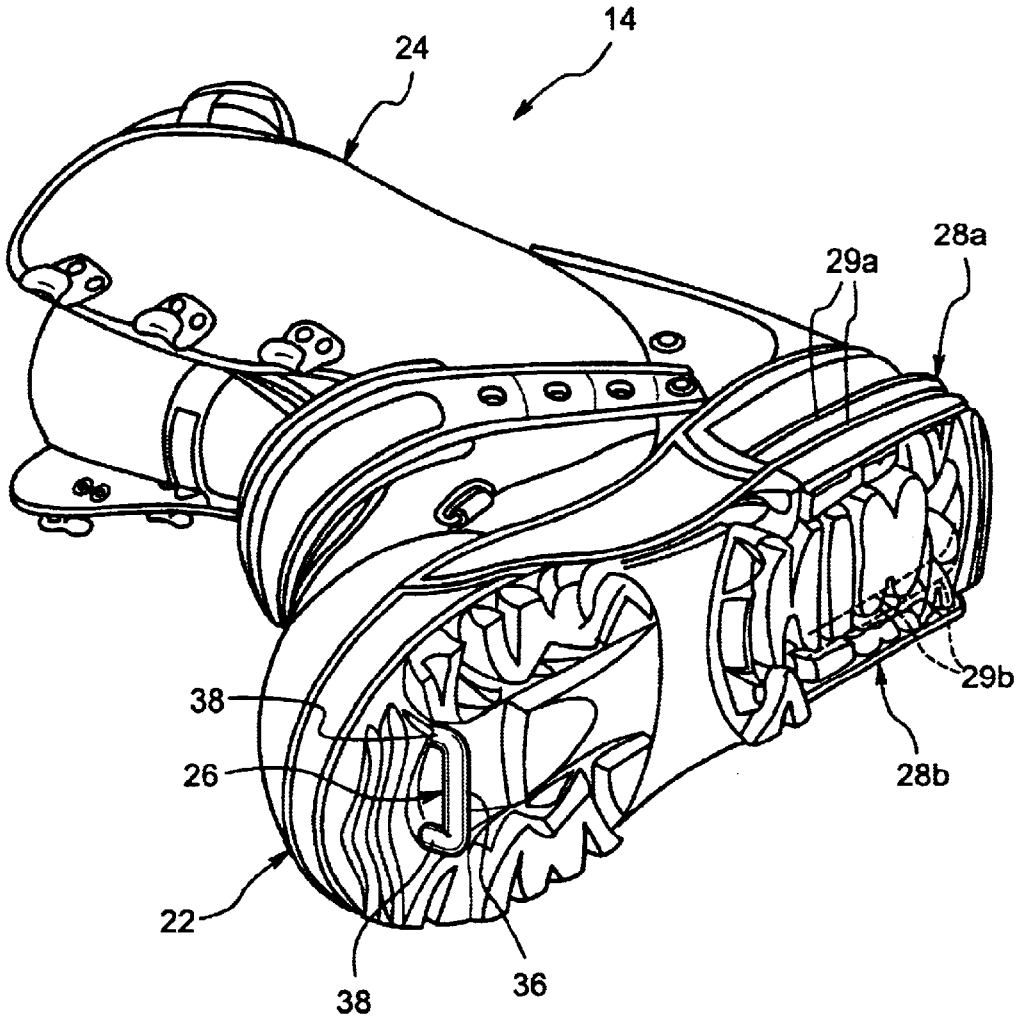
FIG. 4 is a bottom perspective view of the entire snowboard boot illustrated in FIG. 3.

The snowboard boot 14 of the present invention basically has a sole portion 22 and an upper portion 24, as seen in FIGS. 3 and 4. The upper portion 24 is not critical to the present invention, and thus, will not be discussed or illustrated in detail herein. The sole portion 22 has a front catch portion 26 located at a front part of the bottom surface of the sole portion 22. A first rear catch portion 28*a* is located at a first lateral side of the sole portion 22, while a second rear catch portion 28*b* is located at a second lateral side of the sole portion 22. The front catch portion 26 is fixedly coupled to the bottom of sole 22 of the snowboard boot 14. The rear catch portions 28*a* and 28*b* are preferably molded into the lateral sides of the sole portion 22.

More specifically, the front catch portion 26 is preferably either molded into the sole 22 of the snowboard boot 14 or attached thereto via fasteners (not shown). Referring again to FIGS. 1, 3 and 4, the front catch portion 26 is basically a U-shaped member with a bight portion 36 and a pair of leg portions 38 extending from the bight portion 36. As should be appreciated from this disclosure, the present invention is not limited to the precise construction of the front catch portion 26. Rather, the front catch portion 26 can be implemented in any number of ways, and the present invention is not limited to the particular implementations shown in the drawings, which are provided merely for purposes of illustration. In any event, the front catch portion 26 is preferably constructed of hard rigid material, such as steel or any other suitable material, and is fixedly coupled to the snowboard boot 14. The front catch portion 26 is configured to engage a portion of the snowboard binding 12, as discussed below in more detail.

As mentioned above, the rear catch portions 28*a* and 28*b* are preferably molded into the sole portion 22 of the snowboard boot 14. Alternatively, the rear catch portions 28*a* and 28*b* could be removable, and could attached to the snowboard boot 14 via fasteners (not shown). In any event, each of the rear catch portions 28*a* or 28*b* is designed to engage the snowboard binding 12 at a plurality of engagement or locked positions having different heights relative to the snowboard binding 12. More specifically, the rear catch portion 28*a* is formed by molding a plurality (only two illustrated) of V-shaped grooves or notches 29*a* into a (first) lateral side of the sole portion 22 of the snowboard boot 14. The rear catch portion 28*b* is formed by molding a plurality (only two illustrated) of V-shaped grooves into an opposite (second) lateral side of the sole portion 22 of the snowboard boot 14.

Preferably, each of the notches 29*a* has an abutment surface 30*a* angled relative to the bottom surface of sole portion 22, while each of the notches 29*b* has an abutment surface 30*b* angled relative to the bottom surface of sole portion 22. Preferably, each of the abutment surfaces 30*a* or 30*b* forms an angle of about thirty degrees with the bottom surface of sole portion 22. In other words, abutment surfaces 30*a* and 30*b* taper downwardly away from a center plane of snowboard boot 14 and are configured to engage snowboard binding 12 to prevent upward movement of snowboard boot 14 relative to snowboard binding 12. The notches 29*a* and 29*b* also preferably have a depth sufficient to prevent upward movement of snowboard boot 14 relative to snowboard binding 12, and are configured/shaped to mate with snowboard binding 12.

Of course, it will be apparent to those skilled in the art from this disclosure, that the snowboard boot 14 could be designed to have additional engagement or locked positions at different heights if needed and/or desired. For example, the snowboard boot 14 could be designed to have three different engagement positions with three different heights (i.e. three V-shaped grooves), respectively. However, it should be appreciated from this disclosure that the present invention is not limited to the precise construction of the rear catch portions 28*a* and 28*b*. Rather, the rear catch portions 28*a* and 28*b* can be implemented in any number of ways, and the present invention is not limited to the particular implementations shown in the drawings, which are provided merely for the purposes of illustration.

Referring again to FIGS. 1 and 2, the snowboard binding 12 is preferably a highback binding that applies a forward leaning force on the snowboard boot 14. The snowboard binding 12 basically has a base member 40, a front binding member 42 and a pair (first and second) of rear binding members 44*a* and 44*b*. The front binding member 42 is movably coupled to the base member 40 between a release position and a latched position. The pair (first and second) of rear binding members 44*a* and 44*b* are coupled to opposite lateral sides of the base member 40 as discussed in more detail below.

The base member 40 basically includes a base plate 46 adjustably coupled to the snowboard 16 via the adjustment disk 20, a heel cup 48 adjustably coupled to the base plate 46 and a highback 50 adjustably coupled to the heel cup 48. The snowboard binding 12 is preferably adjustably coupled to snowboard 16 via the adjustment disk 20. The rear binding members 44*a* and 44*b* are movable relative to the base member 40 to selectively hold the snowboard boot 14 thereto. The rear binding members 44*a* and 44*b* are arranged to move laterally apart relative to each other from the initial rest positions (FIG. 9) to the guide positions (FIG. 10) upon application of a force in a direction substantially towards the base member 40. The rear binding members 44*a* and 44*b* are also arranged to move laterally toward each other or together to one of the locked positions (FIG. 11 or FIG. 12) upon removal of the force. Thus, the rear binding members 44*a* and 44*b* are arranged to selectively hold the snowboard boot 14 in a plurality of engagement or locked positions having different heights above the base member 40.

The adjustment disk 20 is attached to the snowboard 16 via fasteners or screws 18 that clamp the base plate 46 of the base member 40 to the top surface of the snowboard 16, as seen in FIG. 1. Accordingly, the base member 40 is angularly adjustable relative to the adjustment disk 20 and the snowboard 16 by loosening the fasteners or screws 18. Of course, the base plate 46 of the base member 40 could be attached directly to the snowboard 16, as needed and/or desired. It should be appreciated by those skilled in the art from this disclosure that the attachment of the base member 40 to the snowboard 16 can be accomplished in a number of ways. Moreover, the present invention is not limited to any particular implementation.

Figure 17:
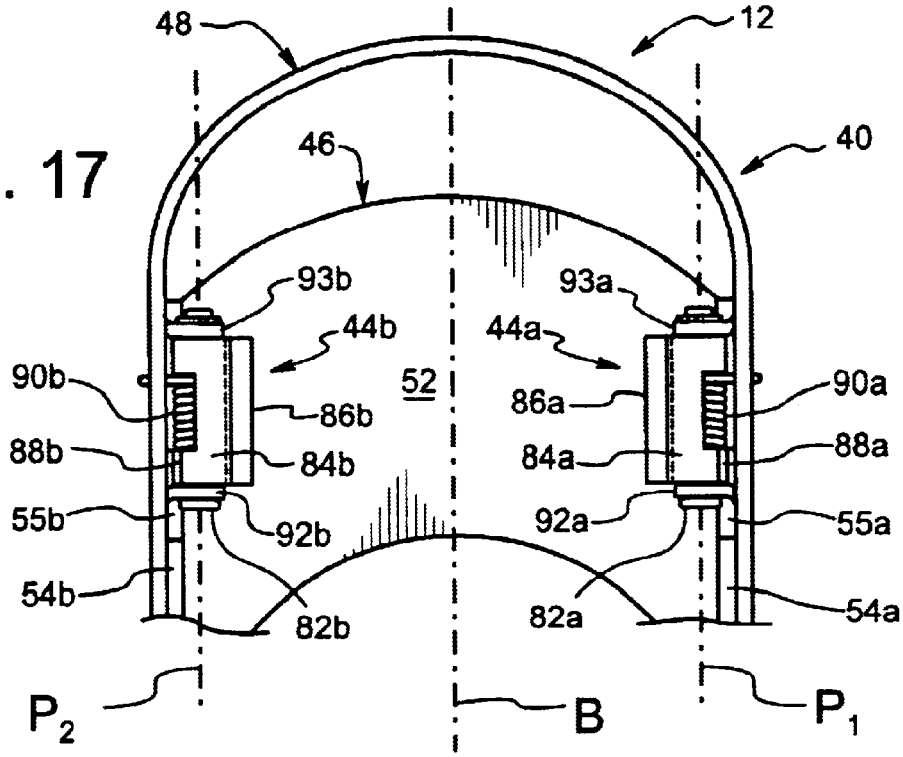
FIG. 17 is a diagrammatic, top plan view of a portion of the snowboard binding illustrated in FIGS. 1, 2 and 5–16.

As seen in FIGS. 1 and 2, the base plate 46 of the base member 40 preferably has a mounting portion 52 and a pair (first and second) of side attachment sections 54*a* and 54*b*. Preferably, the base plate 46 is constructed of a hard, rigid material. Examples of suitable hard rigid materials for the base plate 46 include various metals as well as carbon and/or a metal/carbon combination. In the preferred embodiment, the mounting portion 52 and the side attachment sections 54*a* and 54*b* are formed by bending a metal sheet material. Thus, the base plate 46 is a one-piece, unitary member. Side attachment sections 54*a* and 54*b* are preferably substantially parallel to each other and perpendicular to mounting portion 52, as seen in FIG. 17. Alternatively, side attachment sections 54*a* and 54*b* can taper slightly outwardly from (i.e. away from) each other from the rear portion of snowboard binding 12 toward the front portion of snowboard binding 12, as discussed below in reference to another embodiment of the present invention. The mounting portion 52 has a central opening 56 for receiving the adjustment disk 20 therein. Preferably, the opening 56 has a beveled edge that is serrated to form teeth for engaging a corresponding bevel edge with mating teeth of the adjustment disk 20.

Figure 13:
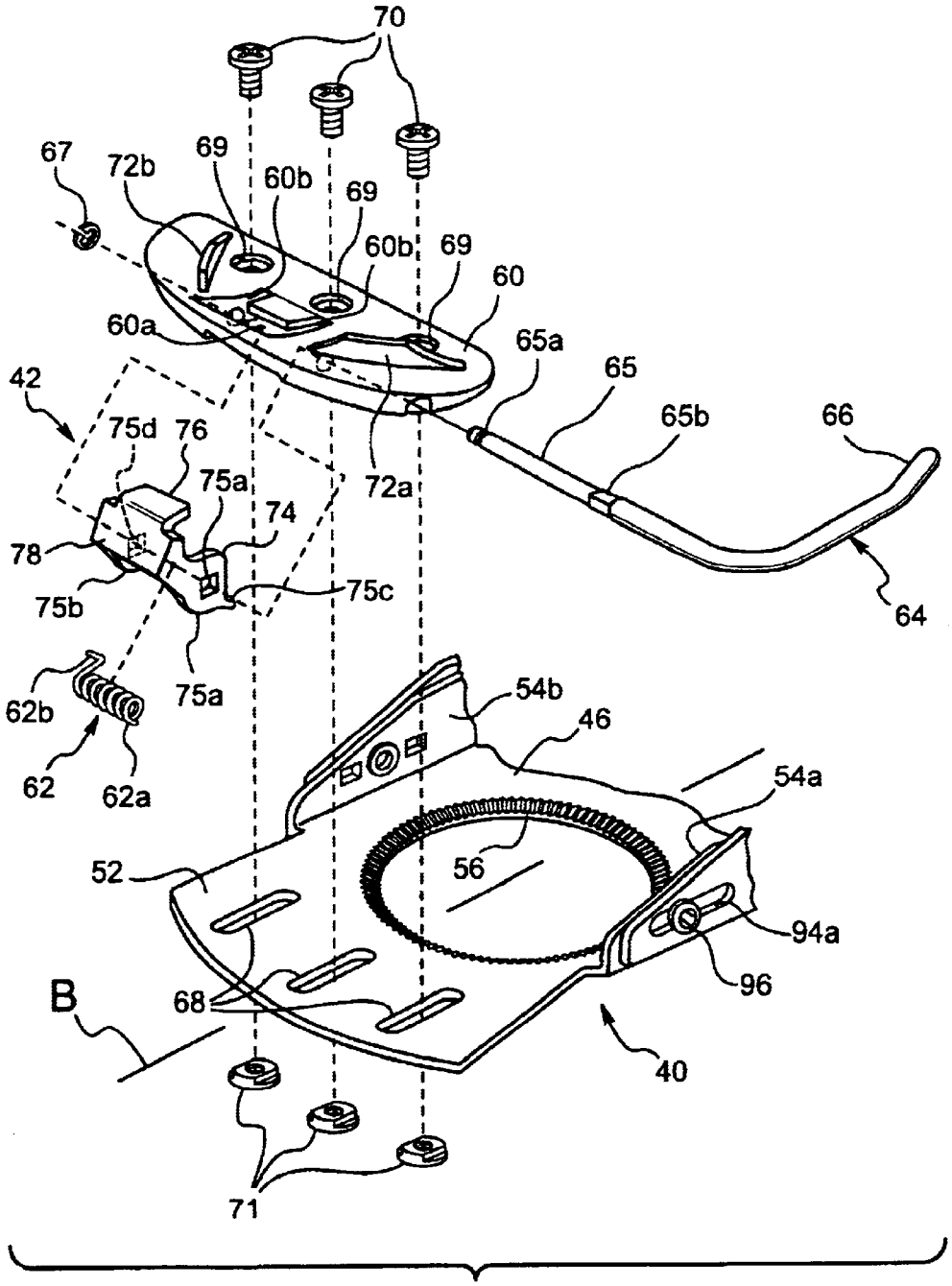
FIG. 13 is a partially exploded perspective view of the snowboard binding illustrated in FIGS. 1, 2 and 5–8 with the front binding member removed for the purpose of illustration.

As seen in FIGS. 2 and 13, the mounting portion 52 of the base plate 46 has a front binding plate 60 fixedly coupled thereto to form a front portion of the base plate 46. The front binding member 42 is movably coupled to the binding plate 60. Thus, when the binding plate 60 is fixedly coupled to the mounting portion 52, the front binding member 42 is movably coupled to the base plate 46 of the base member 40. The base member 40 has a longitudinal center axis B extending between the front portion of the base member 40 (i.e., the binding plate 60) and the rear portion of the base member 40 (i.e., the heel cup 48 and the highback 50). The front binding member 42 is preferably pivotally coupled to the binding plate 60 via a front release lever 64 which functions as a front pivot pin for the front binding member 42. A biasing member 62 is arranged on the front release lever 64 to bias the front binding member 42 toward an engaged or latched position as explained, below. The control or release lever 64 is preferably non-rotatably coupled to the front binding member 42 to move the front binding member 42 against the biasing or urging force of biasing member or spring 62 from the latched position toward the release position.

The release lever 64 basically includes a pivot pin section 65 and a handle or control section 66. In other words, a part the release lever 64 (pivot pin section 65) forms the front pivot pin of the front binding member 42. Thus, die release lever 64 is integrally fanned as a one-piece, unitary member. The pivot pin section 65 preferably includes an annular recess 65*a* formed at a free end thereof. A C-clip 67 (or any other suitable retaining member) is received in the annular recess 65*a* to secure the release lever 64 and the front binding member 42 to the binding plate 60, with the spring 62 arranged therebetween.

Additionally, the binding plate 60 is preferably adjustable (along longitudinal axis B) relative to the mounting portion 52 of the base plate 46. More specifically, the mounting portion 52 includes a plurality (three) of slots 68, while the binding plate 60 includes a plurality (three) through holes 69. A plurality (three) of fasteners or attachment screws 70 are inserted through the holes 69 and the slots 68 and attached to nuts 71 to fixedly couple the binding plate 60 to the mounting portion 52 in an adjustable manner along longitudinal axis B of the base member 40. Thus, front binding member 42 can be selectively coupled at different longitudinal positions relative to base member 40. Of course, it will be apparent to those skilled in the art that various other structures could be utilized to adjust the longitudinal position of the front binding member 42. Moreover, it will be apparent to those skilled in the art that the binding plate 60 could be integrally formed with the base plate 46 if needed and/or desired.

The binding plate 60 preferably includes a pair (first and second) of guide flanges 72*a* and 72*b* extending from an upper surface thereof, which aid in coupling the snowboard boot 14 to the snowboard binding 12. Guide flanges 72*a* and 72*b* are angled relative to longitudinal axis B of the snowboard binding 12 to guide the front catch portion 26 toward longitudinal axis B, and thus, toward the front binding member 42. The engagement between the snowboard boot 14 and the snowboard binding 12 will be discussed in more detail below. Additionally, the release of the snowboard boot 14 from the snowboard binding 12 via the control or the release lever 64 will also be discussed in more detail below.

As best seen in FIG. 13, the front binding member 42 basically includes a mounting portion 74, a binding flange or front pawl 76, a connecting portion 78, the biasing member 62 and the release lever 64. The mounting portion 74 is non-rotatably mounted on the pivot pin section 65 of the release lever 64 for rotation between a latched position and a release position about a front pivot axis. The front pivot axis is arranged below the binding plate 60 such that front pawl or binding flange 76 can be moved out of engagement with the front catch member 26 (i.e. to the release position). The biasing member or spring 62 urges the front pawl 76 toward the latched position. The front pawl 76 includes a lower surface configured to engage an upper surface of bight portion 36 of the front catch portion 26 of the snowboard boot 14. The connecting portion 78 extends between the front pawl 76 and the mounting portion 74.

More specifically, the mounting portion 74 is preferably formed of a pair (first and second) mounting flanges 75*a* and 75*b*. The mounting flange 75*a* preferably includes a protrusion 75*c* extending therefrom. The protrusion 75*c* is designed to engage a first end 62*a* of the spring 62. The other end (second end) 62*b* of spring 62 is designed to be received in a transverse hole (not shown) formed in the mounting plate 60. Thus, the spring 62 is preloaded to urge the front binding member 42 towards the latched position to selectively hold the front catch portion 26 of the snowboard boot 14. Additionally, at least one of the mounting flanges 75*a* and 75*b* preferably includes a non-circular (square) opening 75*d* to non-rotatably receive a non-circular portion 65*b* of the release lever 64. In the illustrated embodiment, both of the mounting flanges include non-circular hole 75*d* such that the release lever 64 could be mounted to extend from either side of the binding plate 60.

The binding plate 60 includes a substantially U-shaped opening 60*a* formed therein, which is configured to partially receive the front binding member 42. A pair of stop surfaces 60*b*, are formed at the rearmost edges of the legs of the U-shaped opening 60*a*. The stop surfaces 60*b* normally hold the front binding member 42 in the latched position. Moreover, because the pivot axis of the front binding member 42 is below bottom surface of the binding plate 60, the front binding member 42 can rotate out of contact with the front catch portion 26. The bottom surface of base member (i.e. the binding plate 60) forms an additional stop surface when the front binding member 42 is in the release position. In this manner, the front pawl 76 can rotate about 90 degrees from the latched position where binding flange or pawl 76 is substantially horizontal to the release position where binding flange or pawl 76 is substantially vertical.

Figure 14:
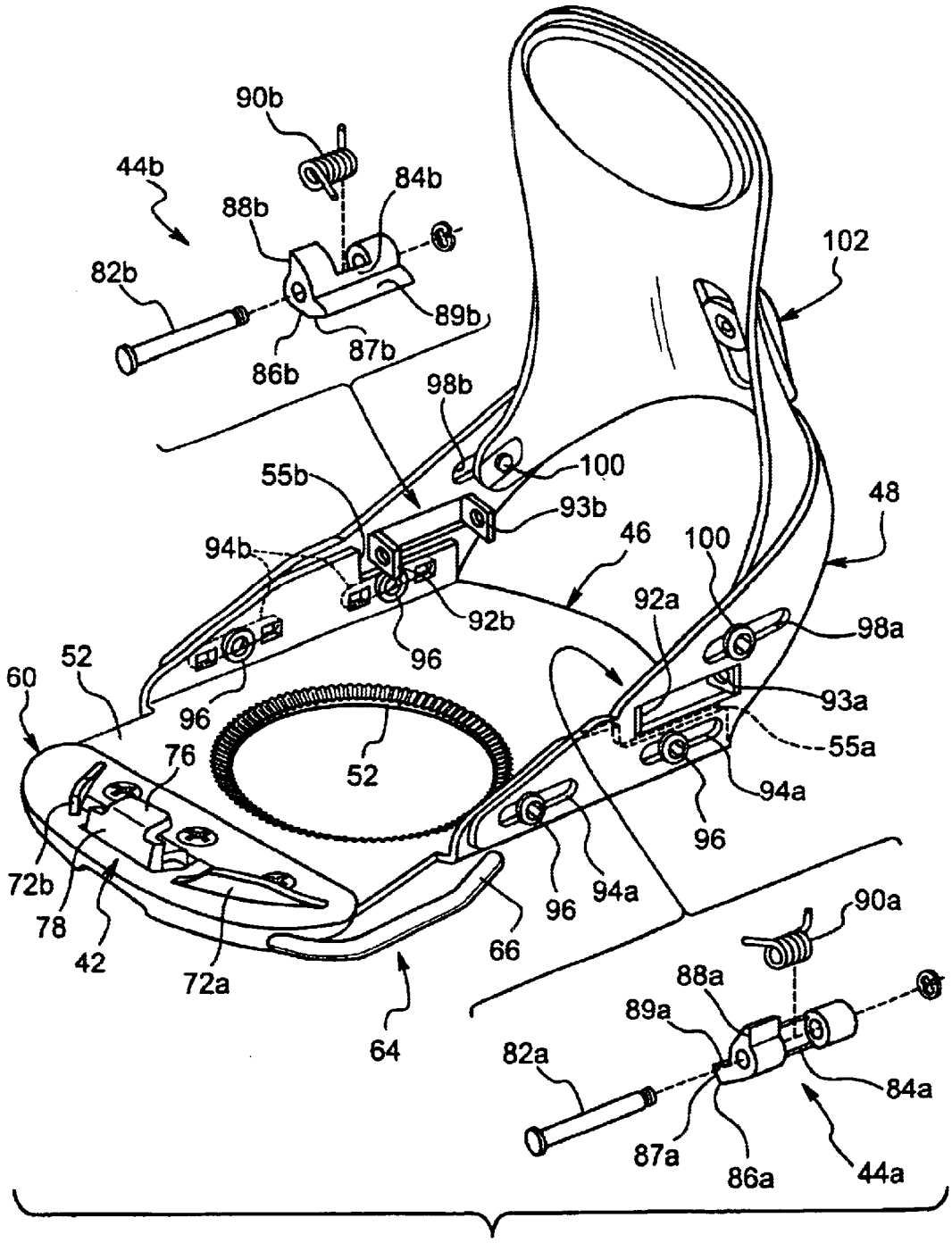
FIG. 14 is a partially exploded perspective view of the snowboard binding illustrated in FIGS. 1, 2 and 5–8 with the rear binding members removed for the purpose of illustration.
Figure 15:
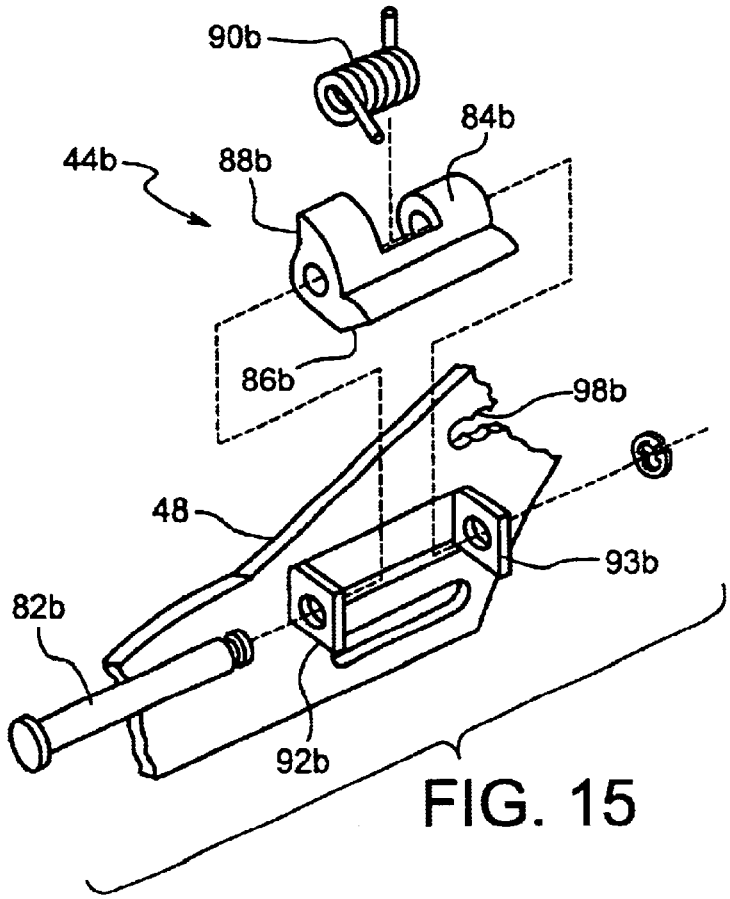
FIG. 15 is an enlarged, exploded perspective view of one of the rear binding members of the snowboard binding illustrated in FIGS. 1, 2 and 5–8.
Figure 16:
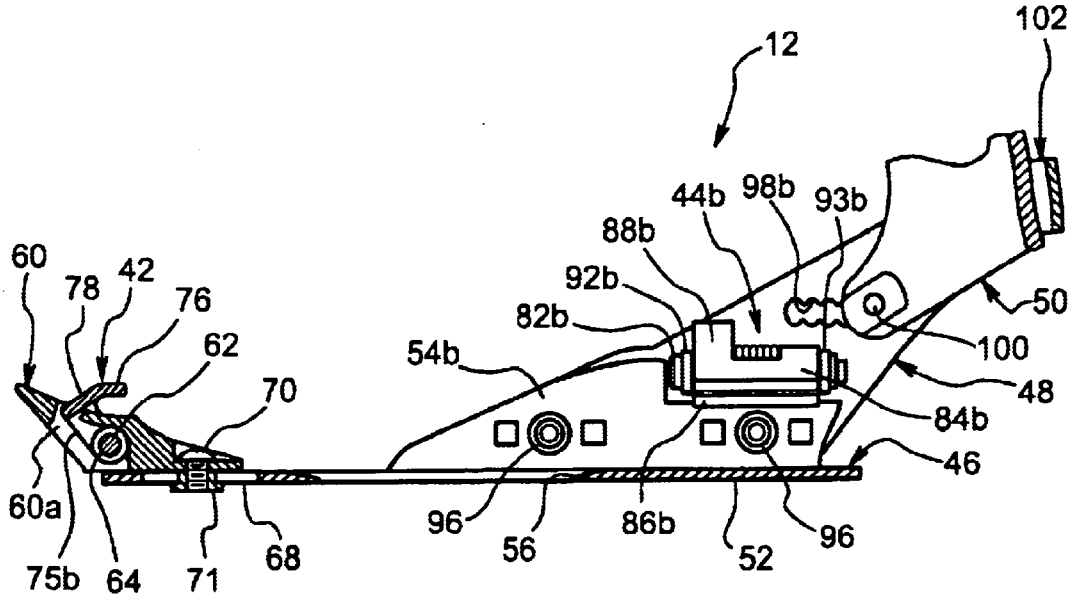
FIG. 16 is a longitudinal cross-sectional view of the snowboard binding system illustrated in FIGS. 1–15 as seen along section line 16—16 of FIG. 2.

As best seen in FIGS. 14 and 15, the rear binding members (first and second) 44*a* and 44*b* are preferably movably coupled to the heel cup 48 of the base member 40. The heel cup 48 is adjustably coupled to the attachment sections 54*a* and 54*b* of the base plate 46 to form a pair (first and second) side attachment portions, as discussed in more detail below. Thus, the rear binding members 44*a* and 44*b* are movably coupled to the base plate 46. The attachment sections 54*a* and 54*b* each include a cutout 55*a* or 55*b*, respectively. The cutouts 55*a* and 55*b* are configured to allow the heel cup 48, with the rear binding members 44*a* and 44*b* coupled thereto, to be adjustably mounted to the base plate 46. Thus, the rear binding members 44*a* and 44*b* are adjustably and movably coupled to the base member 40.

More specifically, the rear binding members 44*a* and 44*b* are pivotally coupled to the base member 40 about a pair (first and second) of pivot axes $P_1$ and $P_2$, respectively. Preferably, the first and second pivot axes $P_1$ and $P_2$ are substantially parallel to each other, and substantially parallel to longitudinal axis B of the snowboard binding 12 as seen in FIG. 17. This arrangement aids in releasing the snowboard boot 14 from the snowboard binding 12, as discussed in more detail below. Of course these center axes could be angled relative to longitudinal axis B as discussed below in reference to another embodiment of the present invention.

The rear binding members 44*a* and 44*b* are preferably substantially mirror images of each other. The rear binding member 44*a* basically includes a (first) pivot pin 82*a*, a (first) body portion 84*a*, a (first) latch member 86*a*, a (first) stop member 88*a* and a (first) biasing member 90*a*. The rear binding member 44*b* basically includes a (second) pivot pin 82*b*, a (second) body portion 84*b*, a (second) latch member 86*b*, a (second) stop member 88*b* and a (second) biasing member 90*b*, as discussed in more detail below. The biasing members or springs 90*a* and 90*b* normally bias latch members 86*a* and 86*b* toward locked positions from guide positions, respectively, as also discussed in more detail below.

The latch members 86*a* and 86*b* are preferably substantially parallel to longitudinal axis B and pivot axes $P_1$ and $P_2$. In any case, latch members 86*a* and 86*b* are configured to mate with notches 29*a* and 29*b* of snowboard boot 14, respectively. Alternatively, latch members 86*a* and 86*b* can be constructed to be angled relative to longitudinal axis B and pivot axes $P_1$ and $P_2$ as discussed below in reference to another embodiment of the present invention. Moreover, rear binding members 44*a* and 44*b* could be mounted to angled side attachment portions such that latch members 86*a* and 86*b* are angled relative to longitudinal axis B, as also discussed below in reference to another embodiment of the present invention. In any event, notches 29*a* and 29*b* of snowboard boot 14 are configured to mate with latch members 86*a* and 86*b*. In other words, if latch member 86*a* and 86*b* are angled relative to longitudinal axis B, notches 29*a* and 29*b* should have a corresponding angle, as discussed below in reference to the other embodiments of the present invention.

The body portion 84*a* of the binding member 44*a* is pivotally mounted on the pivot pin 82*a*. The pivot pin 82*a* is preferably a headed pivot pin with an annular groove formed at a free end thereof. A C-clip (or any other suitable retaining member) is received in the annular groove to retain the rear binding member 44*a* between a pair of flanges 92*a* and 93*a* of heel cup 48. The biasing member 90*a* is preferably a coil spring with one end engaged with an outer later side surface of heel cup 48 and the opposite end engaged with the binding member 44*a* (i.e. a bottom surface of latch member 86*a*) to bias the rear binding member 44*a* toward the locked position. The latch member 86*a* extends from the body portion 84*a* and is configured to engage the grooves or notches 29*a* of the snowboard boot 14. Preferably, the latch member 86*a* forms a first pawl of rear binding member 44*a*. The stop member 88*a* also extends from the body portion 84*a* but in a substantially opposite direction from the latch member 86*a*.

Figure 9:
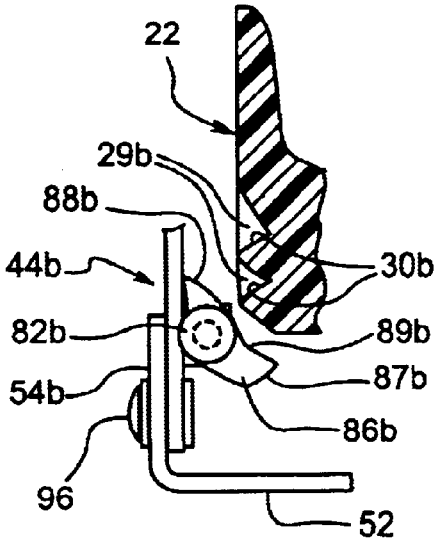
FIG. 9 is a diagrammatic, partial cross-sectional view of one of the rear binding members of the snowboard binding and the snowboard boot illustrated in FIGS. 1–8 prior to coupling the snowboard boot to the snowboard binding (i.e. with the binding member in the initial position)
Figure 10:
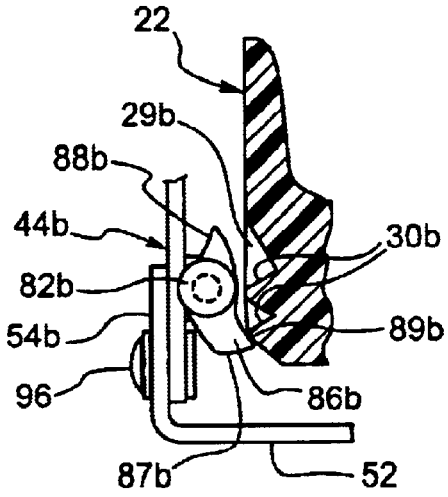
FIG. 10 is a diagrammatic, partial cross-sectional view of the rear binding member and the snowboard boot illustrated in FIG. 9 with the snowboard boot and rear binding member in an intermediate or guide position.
Figure 11:
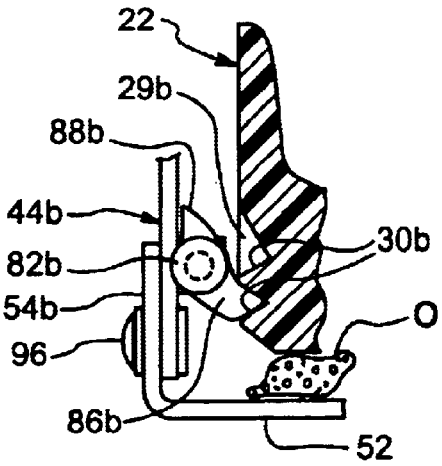
FIG. 11 is a diagrammatic, partial cross-sectional view of the rear binding member and the snowboard boot illustrated in FIGS. 9 and 10 with the snowboard boot and rear binding member in a first locked position.
Figure 12:
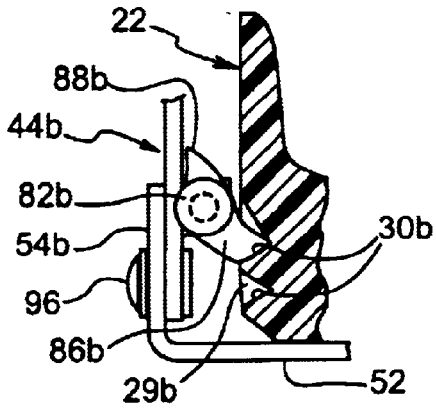
FIG. 12 is a diagrammatic, partial cross-sectional view of the rear binding member and the snowboard boot illustrated in FIGS. 9–11 with the snowboard boot and rear binding member in a second locked position.

More specifically, the stop member 88*a* includes an abutment surface configured to contact an inside surface or lateral side surface of the heel cup 48 when the binding member 44*a* is in the initial rest position. In the locked position, the latch member 86*a* is received in one of the grooves or notches 29*a* of the snowboard boot 14 and the stop surface is slightly spaced from the lateral side surface of the heel cup 48. As seen in FIGS. 11 and 12 (latch member 86*b* illustrated), the latch member 86*a* can be received in either of the lateral grooves or notches 29*a* such that the height of the snowboard boot 14 can be varied relative to the base member 40 (i.e. the mounting portion 52 of the base plate 46). Latch member 86*a* includes a locking surface 87*a* and a guide surface 89*a*, as seen in FIGS. 9, 10 (latch member 86*b* illustrated) and FIG. 14. Locking surface 87*a* engages abutment surface 30*a* when snowboard boot 14 in one of the locked positions.

As mentioned above, the rear binding member 44*b* is preferably a substantially mirror image of the rear binding member 44*a*. The body portion 84*b* of the binding member 44*b* is pivotally mounted on the pivot pin 82*b*. The pivot pin 82*b* is preferably a headed pivot pin with an annular groove formed at a free end thereof. A C-clip (or any other suitable retaining member) is received in the annular groove to retain the rear binding member 44*b* between a pair of flanges 92*b* and 93*b* of the heel cup 48. The biasing member 90*b* is preferably a coil spring with one end engaged with an outer later side surface of the heel cup 48 and the opposite end engaged with binding member 44*a* (i.e. a bottom surface of the latch member 86*b*) to bias the rear binding member 44*b* toward the locked position. The latch member 86*b* extends from the body portion 84*b* and is configured to engage the grooves or notches 29*b* of the snowboard boot 14. Preferably, the latch member 86*b* forms a second pawl of the (second) rear binding member 44*b*. The stop member 88*b* also extends from the body portion 84*b* but in a substantially opposite direction from the latch member 86*b*.

More specifically, the stop member 88*b* includes an abutment surface configured to contact an inside surface or lateral side surface of the heel cup 48 when the binding member 44*b* is in the initial rest position (FIG. 9). In the locked position, latch member 86*b* is received in one of the grooves or notches 29*b* of the snowboard boot 14 and the stop surface is slightly spaced from the lateral side surface of heel cup 48. The latch member 86*b* can be received in either of the lateral grooves or notches 29*b* such that the height of the snowboard boot 14 can be varied relative to the base member 40 (i.e. the mounting portion 52 of the base plate 46). Latch member 86*b* includes a locking surface 87*b* and a guide surface 89*b*, as seen in FIGS. 9, 10 and 14. Locking surface 87*b* engages abutment surface 30*b* when snowboard boot 14 in one of the locked positions.

The heel cup 48 is preferably constructed of a hard rigid material. Examples of suitable hard rigid materials for the heel cup 48 include various metals, as well as carbon and/or a metal/carbon combination. The heel cup 48 is an arcuate member having a pair of slots 94*a* and a pair of slots 94*b* at each of the lower free ends that are attached to the side attachment sections 54*a* and 54*b*, respectively, of the base plate 46. The slots 94*a* and 94*b* receive the fasteners 96 therein to adjustably couple the heel cup 48 to the base plate 46. Additional slots 98*a* and 98*b* are provided in the heel cup 48 to attach the highback 50 to the heel cup 48 via fasteners 100. Accordingly, the heel cup 48 is adjustably coupled to the base plate 46 and the highback 50 is adjustably coupled to the heel cup 48 to form the base member 40. Thus, rear binding members 44*a* and 44*b* can be selectively coupled at different longitudinal positions relative to base member 40.

The highback 50 is a rigid member constructed of a hard rigid material. Examples of suitable hard rigid materials for the highback 50 include a hard rigid plastic material or various composite types of materials. Of course, the highback 50 could also be constructed of various metals. The highback 50 has a substantially U-shaped bottom portion with a pair of holes for receiving fasteners 100. The fasteners 100 are adjustably coupled within slots 98*a* and 98*b* of the heel cup 48 to allow adjustment of the highback 50 about a vertical axis. The highback 50 is pivotally coupled to the heel cup 48 by the fasteners 100. The connections between the highback 50, the heel cup 48 and the base plate 46 are relatively conventional. Accordingly, it will be apparent to those skilled in the art that these members could be attached in any number of ways, and that the present invention should not be limited to any particular implementation of these connections.

The highback 50 also preferably has a conventional forward lean or incline adjuster 102 that engages the heel cup 48 to cause the highback 50 to lean forward relative to the base member 40. The precise construction of the forward lean adjuster 102 is not relevant to the present invention. Moreover, the forward lean adjuster 102 is well known in the art, and thus, will not be discussed or illustrated herein. Of course, it will be apparent to those skilled in the art from this disclosure that the forward lean adjustment can be implemented in any number of ways, and that the present invention should not be limited to any particular implementation of the forward lean adjustment.

The snowboard binding system 10, in accordance with the present invention, allows for the snowboard boot 14 to be attached to the snowboard binding 12 when the highback 46 is in its forward-most lean position. Specifically, the front and rear binding members 42, and 44*a* and 44*b* are arranged such that when the rider steps into the binding 12, the snowboard boot 14 moves rearwardly against the highback 50 during the engagement process. In other words, during engagement of the front catch portion 26 to the binding 12, the upper portion of the snowboard boot 14 contacts the highback 50 such that the highback 50 flexes the upper portion of the snowboard boot 14 forward relative to the binding 12.

Figure 5:
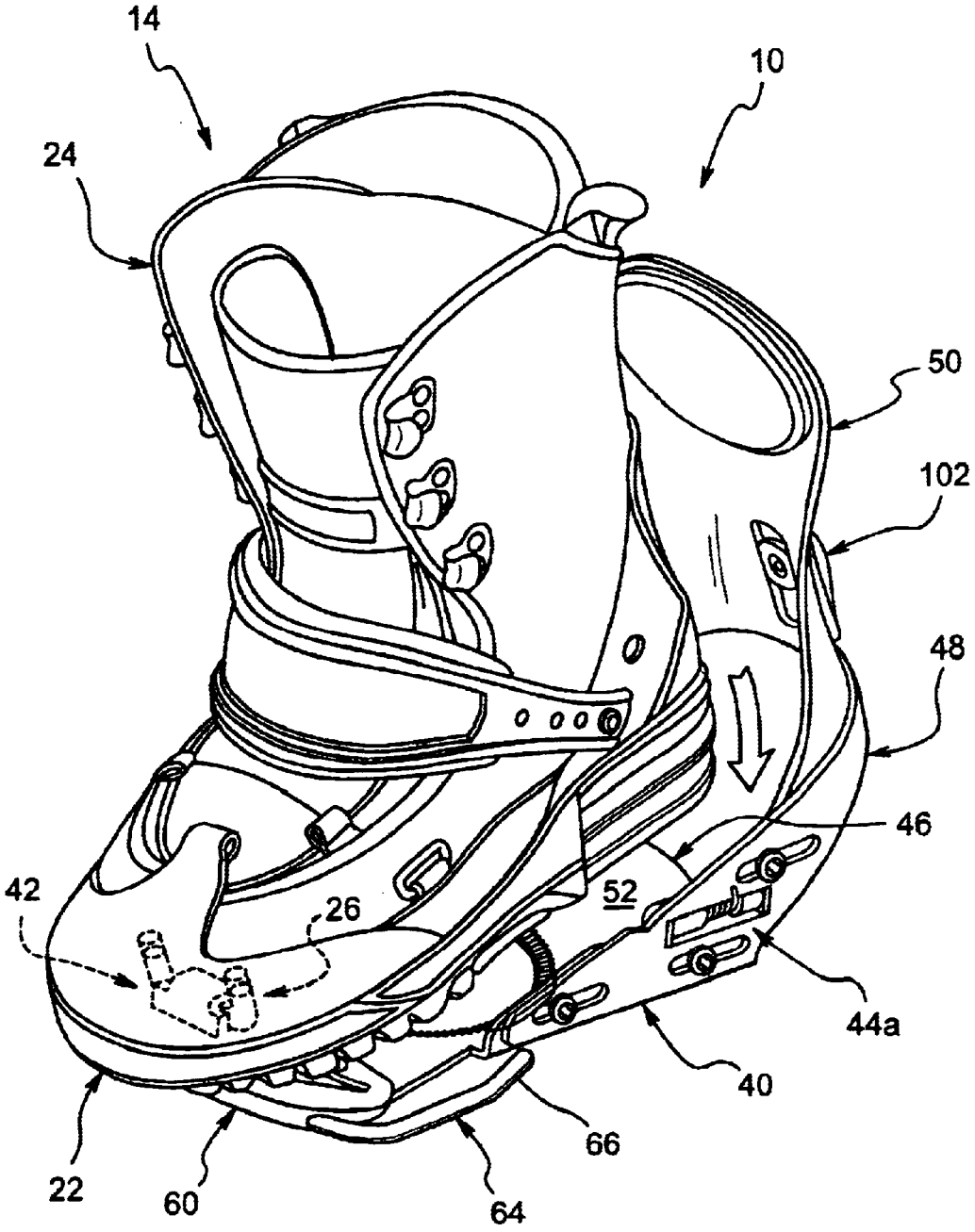
FIG. 5 is an enlarged perspective view of the snowboard binding system illustrated in FIGS. 1–4 showing the snowboard boot in a first position partially engaged with the snowboard binding.

Referring to FIGS. 5–8 and 9–12, mounting and dismounting the snowboard boot 14 with the snowboard binding 12 will now be discussed in more detail. When the rider wants to enter the snowboard binding 12, boot 14 should be slightly inclined as seen in FIGS. 5 and 9. The front catch portion 26 is first engaged with the front binding member 42. Specifically, the front catch portion 26 is positioned beneath the front binding flange or pawl 76. Then the rider moves the heal or rear portion of the snowboard boot 14 in a direction substantially towards the base member 40 (i.e. toward the base plate 46). In other words, the snowboard boot 14 pivots rearwardly about the front catch portion 26 such that the rear of the snowboard boot 14 moves substantially toward the base member 40.

Figure 6:
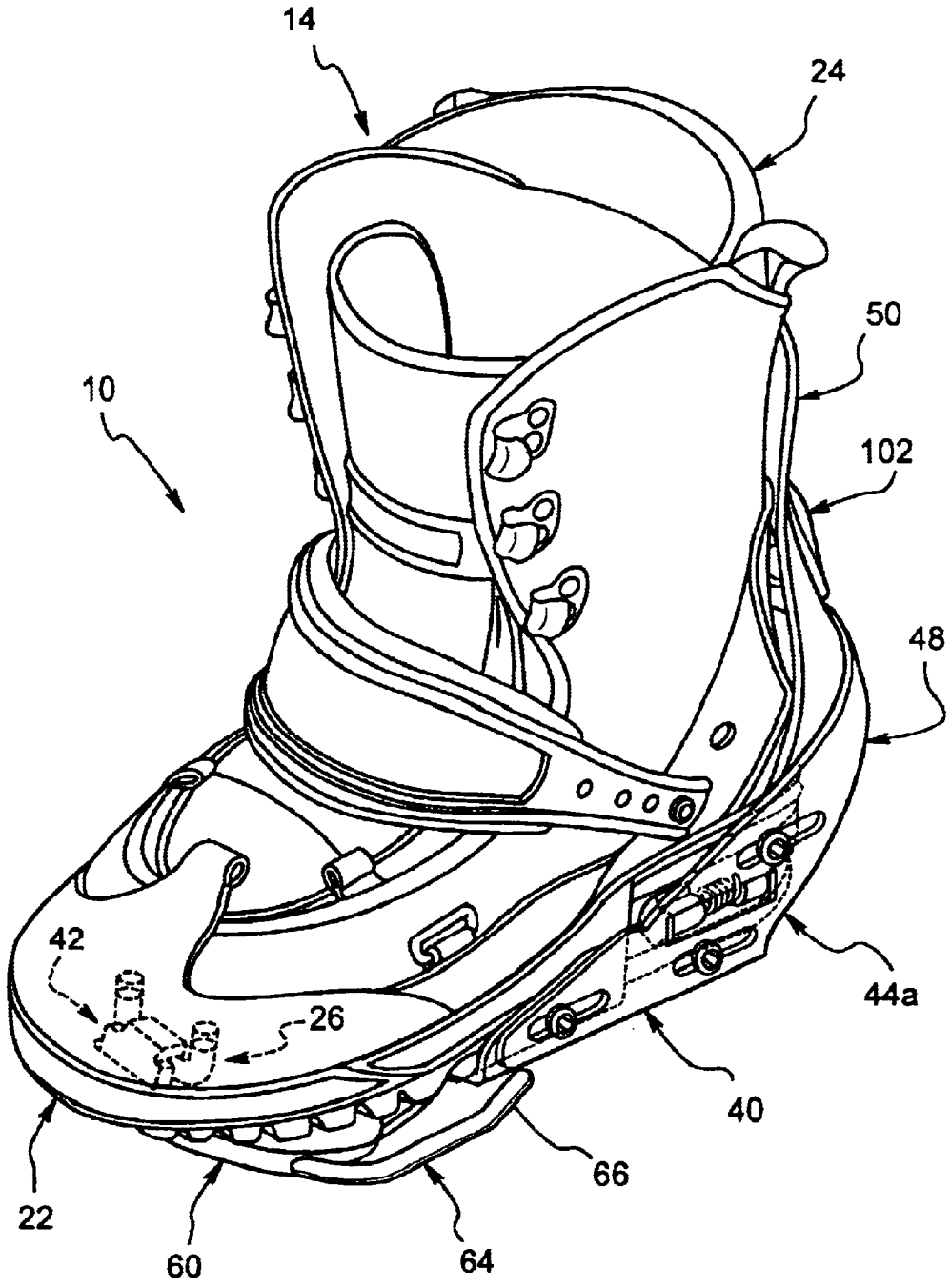
FIG. 6 is an enlarged perspective view of the snowboard binding system illustrated in FIGS. 1–5 showing the snowboard boot in a second position completely engaged with the snowboard binding.

As seen in FIG. 10, this movement of the snowboard boot 14 causes the rear binding members 44*a* and 44*b* to pivot against the biasing force of the springs 90*a* and 90*b*, respectively. Thus, the rear latch members 86*a* and 86*b* move laterally away from longitudinal axis B into guide positions (first and second guide positions, respectively) such that the snowboard boot 14 can be moved downwardly. As best seen in FIGS. 6 and 11, once the rear catch portions 28*a* and 28*b* move a predetermined distance, the rear latch members 86*a* and 86*b* move from the (first and second) guide positions to (first and second) locking positions. Thus snowboard boot 14 is in a first locked position. In this first locked position, the rear of the sole portion 22 is slightly spaced from the mounting portion 52 of the base plate 46. Thus an obstruction O, such as snow, mud or sand can be accommodated if needed as seen in FIG. 11. As seen in FIG. 12, the snowboard boot 14 can be further moved into a second locked position, if no obstruction O prevents such movement. In this second locked position, the rear latch members 86*a* and 86*b* move from intermediate (first and second) guide positions (not shown) to additional (first and second) locking positions, respectively. Thus snowboard boot 14 is in a second locked position.

Figure 7:
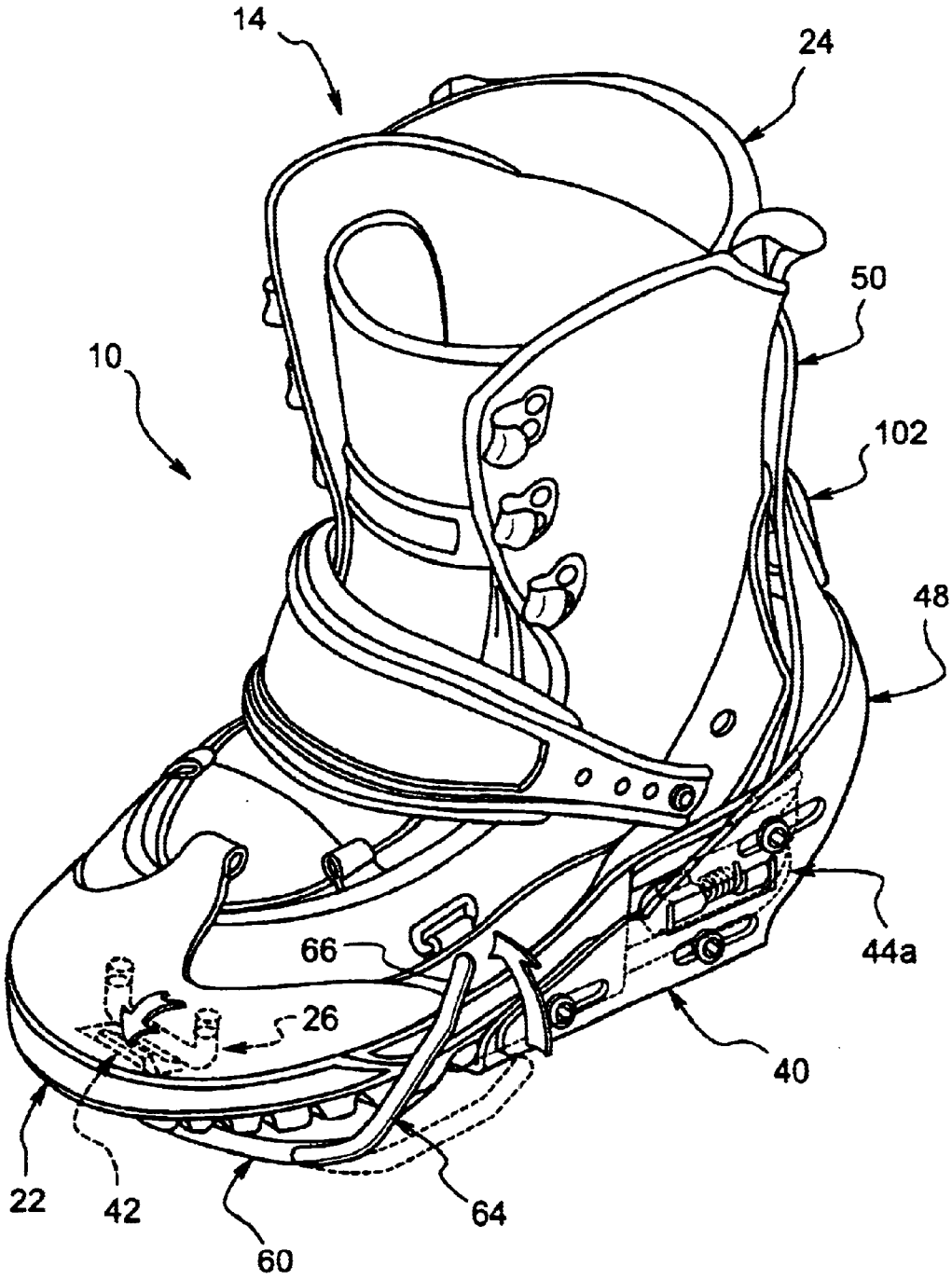
FIG. 7 is an enlarged perspective view of the snowboard binding system illustrated in FIGS. 1–6 showing the snowboard boot in the second position after moving a control lever to release the front of the snowboard boot from the snowboard binding (previous position of the control lever shown in broken lines)
Figure 8:
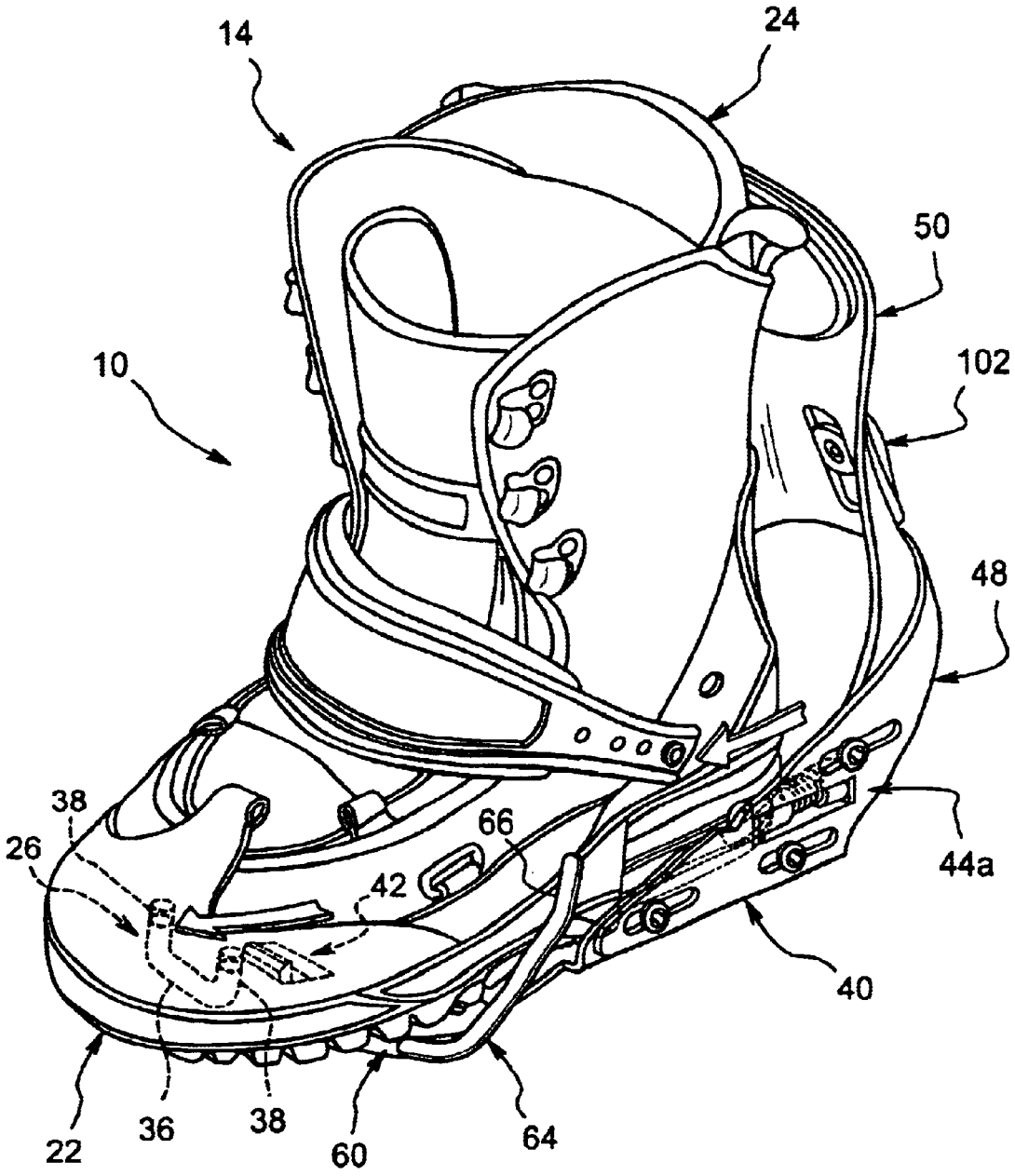
FIG. 8 is an enlarged perspective view of the snowboard binding system illustrated in FIGS. 1–7 showing the snowboard boot in a third position after moving the control lever to release the front of the snowboard boot and after sliding the snowboard boot forward (in order to completely release the snowboard boot from the snowboard binding.

Release of the snowboard boot 14 from snowboard binding 12 will now be discussed in more detail. Snowboard binding 12 can easily release the snowboard boot 14 therefrom, when the snowboard boot 14 is in either of the locked positions (FIGS. 6, 11 and 12). Specifically, as seen in FIG. 7, the release lever 64 is pivoted in order to move the front binding member 42 from the latched position (FIG. 6) to the release position. Thus, the front catch portion 26 of the snowboard boot 14 is released from the snowboard binding 12. However, the rear binding members 44*a* and 44*b* remain in the engagement or locking positions. In order to completely, detach the snowboard boot 14 from snowboard binding 12, the snowboard boot 14 is then moved longitudinally (i.e. along longitudinal axis B) such that the rear pawls 86*a* and 86*b* slide in notches 29*a* and 29*b*, respectively. After the boot 14 is moved a sufficient distance, the rear pawls 86*a* and 86*b* will not engage or lock notches 29*a* and 29*b*. Thus the snowboard boot 14 can be completely released from snowboard binding 12.

Second Embodiment

Figure 18:
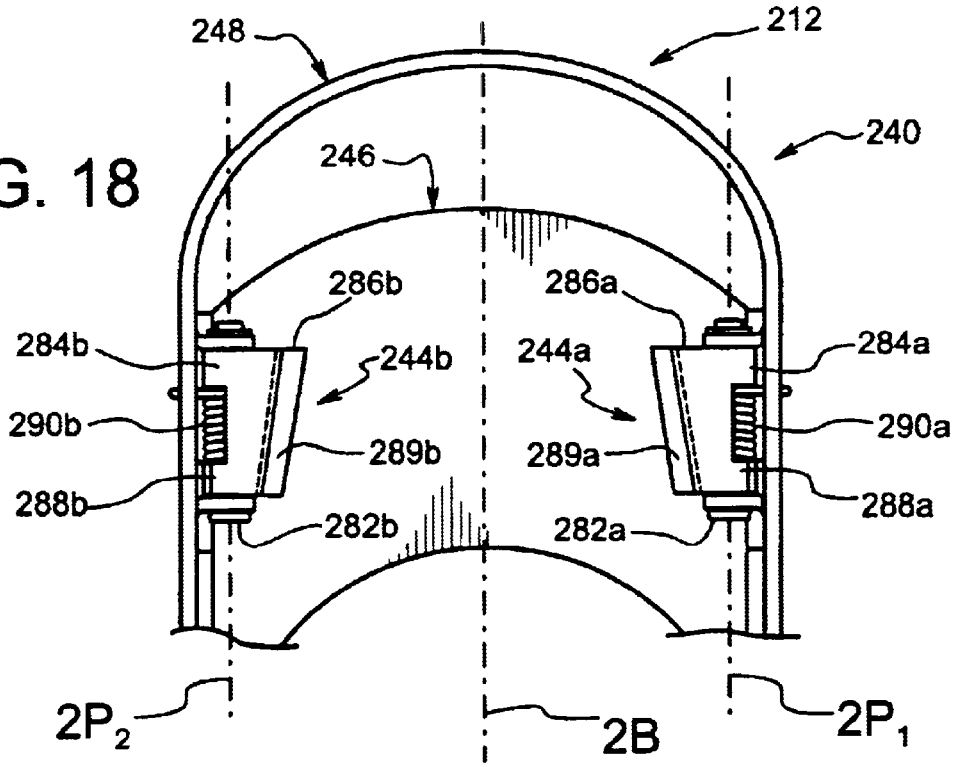
FIG. 18 is a diagrammatic, top plan view of a portion of a snowboard binding in accordance with a second embodiment of the present invention.

Referring now to FIG. 18, a portion of a snowboard binding 212 is illustrated in accordance with a second embodiment of the present invention. Snowboard binding 212 of this second embodiment is identical to snowboard binding 12 of the first embodiment, except that snowboard binding 212 has a pair (first and second) of rear binding members 244*a* and 244*b* that are modified versions of rear binding members 44*a* and 44*b* of the first embodiment. Snowboard binding 212 is designed to be used with a snowboard boot identical or substantially identical to snowboard boot 14 of the first embodiment. Since snowboard binding 212 of the second embodiment is substantially identical to snowboard binding 12 of the first embodiment, snowboard binding 212 will not be discussed or illustrated in detail herein. Rather, the following description will focus mainly on the differences. Moreover, it will be apparent to those skilled in the art that most of the descriptions of snowboard binding system 10, snowboard binding 12 and snowboard boot 14 of the first embodiment apply to snowboard binding 212 of this second embodiment.

Snowboard binding 212 basically includes a base member 240, a front binding member (not shown) and the pair (first and second) of rear binding members 244*a* and 244*b*. Base member 240 of this second embodiment basically includes a base plate 246, a heel cup 248 and a highback (not shown). Base member 240 is identical to base member 40 of the first embodiment. Thus, base member 240 will not be discussed or illustrated in detail herein. Moreover, the front binding member (not shown) of snowboard binding 212 is identical to front binding member 42 of the first embodiment. Accordingly, the front binding member of this second embodiment will not be discussed or illustrated in detail herein. As mentioned above, rear binding members 244*a* and 244*b* are modified versions of rear binding members 44*a* and 44*b* of the first embodiment. More specifically, rear binding member 44*a* basically includes a (first) pivot pin 282*a*, a (first) body portion 284*a*, a (first) latch member 286*a*, a (first) stop member 288*a* and a (first) biasing member 290*a*. The rear binding member 244*b* basically includes a (second) pivot pin 282*b*, a (second) body portion 284*b*, a (second) latch member 286*b*, a (second) stop member 288*b* and a (second) biasing member 290*b*. Rear binding members 244*a* and 244*b* are pivotally coupled to the base member 240 about a pair (first and second) pivot axes $2P_1$ and $2P_2$ in a manner identical to the first embodiment. In other words, body portion 284*a* is pivotally mounted on pivot pin 282*a* while body portion 284*b* is pivotally mounted on pivot pin 282*b*. On the other hand, latch members 286*a* and 286*b* are slightly modified versions of latch members 86*a* and 86*b* of the first embodiment. Specifically, latch member 286*a* includes a locking surface (not shown) and a guide surface 289*a* while latch member 286*b* includes a locking surface (not shown) and a guide surface 289*b*. Latch members 286*a* and 286*b* (i.e. lock surfaces and guide surfaces 289*a* and 289*b*) are identical to latch members 86*a* and 86*b*, except latch members 286*a* and 286*b* are angled relative to a center longitudinal axis 2B of base member 240. In other words, (first and second) elongated locking surfaces (not shown) diverge relative to longitudinal axis 2B of base member 240 as the elongated locking surfaces extend from the rear portion of the base member 240 towards the front portion (not shown). Moreover, latch members 286*a* and 286*b* are angled relative to pivot axes $2P_1$ and $2P_2$. In other words, snowboard binding 212 is designed to be used with a snowboard boot with angled notches that correspond in shape to latch members 286*a* and 286*b*.

Third Embodiment

Referring now to FIG. 19, a snowboard binding 312 is illustrated in accordance with a third embodiment of the present invention. Snowboard binding 312 of this third embodiment is substantially identical to snowboard binding 12 of the first embodiment except snowboard binding 312 utilizes a base member 340 which is a modified version of base member 40 of the first embodiment. Snowboard binding 312 is designed to be used with a snowboard boot identical or substantially identical to snowboard boot 14 of the first embodiment. Since snowboard binding 312 of this third embodiment is substantially identical to snowboard binding 12 of the first embodiment, snowboard binding 312 will not be discussed or illustrated in detail herein. Rather, the following description will focus mainly on the differences. Moreover, it will be apparent to those skilled in the art that most of the descriptions of snowboard binding system 10, snowboard binding 12 and snowboard boot 14 of the first embodiment apply to snowboard binding 312 of this third embodiment.

Snowboard binding 312 basically includes the modified base member 340, a front binding member (not shown) and a pair (first and second) of rear binding members 344*a* and 344*b*. The front binding member (not shown) of snowboard binding 312 is identical to front binding member 42 of the first embodiment. Moreover, rear binding members 344*a* and 344*b* are identical to rear binding members 44*a* and 44*b* of the first embodiment. Thus, the front binding member (not shown) and the rear binding members 344*a* and 344*b* will not be discussed or illustrated in detail herein. Modified base member 340 is identical to base member 40 of the first embodiment except that the shape has been slightly modified such that rear binding members 344*a* and 344*b* are slightly angled relative to a center longitudinal axis 3B of base member 340. Base member 340 basically includes a base plate 346, a heel cup 348 and a highback (not shown). Base plate 346 includes a mounting portion 352 and a pair (first and second) of side attachment sections 354*a* and 354*b*. Base plate 346 is identical to base plate 46 of the first embodiment except that attachment sections 354*a* and 354*b* are slightly angled relative to center longitudinal axis 3B. Moreover, heel cup 348 is identical to heel cup 48 of the first embodiment, except that the shape of heel cup 348 has been modified to be used with the modified base plate 346. In other words, the free ends of heel cup 348 are also preferably slightly angled relative to center longitudinal axis 3B. Moreover, the highback (not shown) of snowboard binding 312 may be slightly modified in order to be utilized with base plate 346 and heel cup 348. However, the highback is preferably formed of a material, which has limited flexibility such that highback 50 of the first embodiment could also be used with base plate 346 and heel cup 348. Due to the configurations of base plate 346 and heel cup 348, rear binding members 344*a* and 344*b* are angled relative to center axis 3B. More specifically, rear binding members 344*a* and 344*b* are pivotally coupled to the base member 340 about a pair (first and second) of pivot axes $3P_1$ and $3P_2$, respectively. Pivot axes $3P_1$ and $3P_2$ are angled (i.e. diverge from axis 3B toward the front portion of base member 340) relative to longitudinal axis 3B. Moreover, rear binding member 344*a* has a latch member 386*a* while rear binding member 344*b* has a latch member 386*b*. Thus, latch members 386*a* and 386*b* are angled relative to center longitudinal axis 3B. In other words, rear binding members 344*a* and 344*b* are identical to rear binding members 44*a* and 44*b* of the first embodiment, except that the orientation of rear binding member 344*a* and the orientation of rear binding member 344*b* have been modified due to the configuration of base member 340. In other words, (first and second) elongated locking surfaces (not shown) diverge relative to longitudinal axis 3B of base member 340 as the elongated locking surfaces extend from the rear portion of the base member 340 towards the front portion (not shown). Thus, snowboard binding 312 is designed to be used with a snowboard boot with angled notches that correspond in shape to latch members 386*a* and 386*b*.

Fourth Embodiment

Referring now to FIG. 20, a portion of a snowboard binding system 410 is illustrated in accordance with a fourth embodiment of the present invention. Snowboard binding system 410 of this fourth embodiment is substantially identical to snowboard binding system 10 of the first embodiment, except snowboard binding system 410 includes a base member 440, which is a modified version of base member 40 of the first embodiment. Snowboard binding system 410 has a snowboard binding 412, which is designed to be used with a snowboard boot identical or substantially identical to snowboard boot 14 of the first embodiment. Since snowboard binding system 410 is substantially identical to snowboard binding system 10 of the first embodiment, snowboard binding system 410 will not be discussed or illustrated in detail herein. Rather, the following description will focus mainly on the differences. Moreover, it will be apparent to those skilled in the art that most of the descriptions of snowboard binding system 10 of the first embodiment also apply to snowboard binding system 410 of this fourth embodiment.

Snowboard binding system 410 basically includes snowboard binding 412 and a snowboard boot 414. Snowboard boot 414 is identical to snowboard boot 14 of the first embodiment. Thus, snowboard boot 414 will not be discussed or illustrated in detail herein. Snowboard binding 412 basically includes a base member 440, a front binding member (not shown) and a pair (first and second) of rear binding members (only one shown). The front binding member (not shown) of snowboard binding 412 is identical to front binding member 42 of the first embodiment. Moreover, the rear binding members (only one rear binding member 444*b* shown) are also identical to rear binding members 44*a* and 44*b* of the first embodiment. On the other hand, base member 440 is a modified version of base member 40 of the first embodiment. More specifically, base member 440 includes a base plate 446, a heel cup 448 and a highback (not shown). Base plate 446 and the highback (not shown) of base member 440 are identical to base plate 46 and highback 50 of the first embodiment. However, heel cup 448 is a modified version of heel cup 48 of the first embodiment. Specifically, heel cup 448 has a pair of flared sections or support members (only one shown) 449 formed at the free ends of heel cup 448 to aid in guiding snowboard boot 414 into snowboard binding 412. Support members 449 are slanted upwardly and outwardly from base plate 446. Support members 449 can be slightly curved if needed and/or desired.

The terms of degree such as "substantially", "about" and "approximately" as used herein mean a reasonable amount of deviation of the modified term such that the end result is not significantly changed. These terms should be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing description of the embodiments according to the present invention are provided for illustration only, and not for the purpose of limiting the invention as defined by the appended claims and their equivalents.

What is claimed is:

1. A snowboard binding comprising:

a base member including a base plate adapted to be coupled to a top surface of a snowboard and a side attachment portion extending upwardly from said base plate, said base plate having a front portion, a rear portion and a longitudinal axis extending between said front and rear portions, said side attachment portion being located at said rear portion; and a rear binding member coupled to said side attachment portion at a first lateral side of said rear portion of said base plate to extend inwardly toward said longitudinal axis into a snowboard boot receiving area above said base plate, said rear binding member including a latch member movable relative to said base member, said latch member being pivotally supported about a pivot axis substantially parallel to said longitudinal axis to selectively engage a heel portion of the snowboard boot, said latch member being arranged to move downwardly toward said base member and laterally outwardly away from said longitudinal axis upon application of a force on said latch member in a direction substantially towards said base member by the snowboard boot, and to move upwardly away from said base member and laterally inwardly upon removal of said force, said rear binding member being configured and arranged without a lever portion that extends away from said longitudinal axis out of said boot receiving area beyond said side attachment portion to release said rear binding member.

2. A snowboard binding comprising:

a base member including a base plate adapted to be coupled to a top surface of a snowboard and first and second side attachment portions extending upwardly from said base plate, said base plate having a front portion, a rear portion and a longitudinal axis extending between said front and rear portions, said first and second side attachment portions being located at said rear portion;

a first rear binding member coupled to said first side attachment portion at a first lateral side of said rear portion of said base plate to extend inwardly toward said longitudinal axis into a snowboard boot receiving area above said base plate, said first rear binding member including a first latch member movable relative to said base member, said first latch member being pivotally supported about a first pivot axis substantially parallel to said longitudinal axis, said first latch member being configured to engage a first rear catch portion of a snowboard boot; and a second rear binding member coupled to said second side attachment portion at a second lateral side of said rear portion of said base plate to extend inwardly toward said longitudinal axis into said snowboard boot receiving area above said base plate, said second rear binding member including a second latch member movable relative to said base member, said second latch member being pivotally supported about a second pivot axis substantially parallel to said longitudinal axis, said second latch member being configured to engage a second rear catch portion of the snowboard boot, said first and second latch members being arranged to move downwardly toward said base member and laterally outwardly away from each other and away from said longitudinal axis upon application of a force on said first and second latch members in the direction substantially towards said base member by the snowboard boot, and to move upwardly away from said base member and laterally inwardly upon removal of said force, said first and second rear binding members being configured and arranged without lever portions that extend away from said first and second longitudinal axes out of said boot receiving area beyond said first and second side attachment portions to release said first and second rear binding members, respectively.

3. A snowboard binding according to claim 2, further comprising a front binding member movably coupled to said front portion of said base member between a release position and a latched position.

4. A snowboard binding according to claim 2, wherein said first and second latch members are arranged to move laterally apart relative to each other from first and second initial positions to first and second guide positions upon application of said force on said first and second latch members in said direction substantially towards said base member.

5. A snowboard binding according to claim 4, wherein said first latch member is arranged to move from said first guide position to a first locking position to selectively hold the first rear catch portion of the snowboard boot; and said second latch member is arranged to move from said second guide position to a second locking position to selectively hold the second rear catch portion of the snowboard boot.

6. A snowboard binding according to claim 2, wherein said first and second latch members are normally urged to first and second initial positions by first and second biasing members, respectively.

7. A snowboard binding according to claim 2, wherein said first and second latch members are first and second pawls that are normally urged by first and second biasing members from first and second guide positions to first and second locking positions, respectively, said first pawl includes a first locking surface and a first guide surface, said second pawl includes a second locking surface and a second guide surface.

8. A snowboard binding according to claim 7, wherein said first pawl is pivotally supported about said first pivot axis, and said second pawl is pivotally supported about said second pivot axis.

9. A snowboard binding according to claim 2, wherein said base plate includes a mounting portion with said first and second side attachment portions extending perpendicularly from said mounting portion.

10. A snowboard binding according to claim 9, wherein said base member further includes a highback support extending upwardly relative to said rear portion of said base member.

11. The snowboard binding according to claim 1, further comprising a front binding member movably coupled to said front portion of said base plate between a release position and a latched position, said front binding member including a connecting portion coupled to said front portion of said base member and a binding flange extending from said connecting portion that is arranged to move in a forward and downward direction relative to said base member when moving from said latched position to said release position relative to said longitudinal axis, said binding flange being arranged and configured to limit upward movement of a front catch of the snowboard boot in said latched position and said connecting portion extending from a forward end of said binding flange in said latched position such that said connecting portion is configured to limit forward movement of the front catch of the snowboard boot along said longitudinal axis in said latched position.

12. A snowboard binding according to claim 11, wherein said front binding member includes a front pawl urged in a rear direction to said latched position by a front biasing member that applies an urging force on said front pawl, and a release lever coupled to said front pawl to move said front pawl from said latched position to said release position upon application of a force on said release lever that is greater than said urging force of said front biasing member.

13. A snowboard binding according to claim 11, wherein said front binding member is longitudinally adjustable relative to said front portion of said base member such that said front binding member can be selectively coupled at different longitudinal positions relative to said base member.

14. A snowboard binding according to claim 13, wherein said rear binding member is longitudinally adjustable relative to said rear portion of said base member such that said rear binding member can be selectively coupled at different longitudinal positions relative to said base member.

15. A snowboard binding according to claim 1, wherein said rear binding member is longitudinally adjustable relative to said rear portion of said base member such that said rear binding member can be selectively coupled at different longitudinal positions relative to said base member.

16. A snowboard binding according to claim 2, wherein said first and second side attachment portions have first and second support members that are slanted upwardly and outwardly relative to said base plate, respectively.

17. A snowboard binding according to claim 16, wherein said support members are part of a heel cup with a highback support mounted thereto.

18. A snowboard binding system, comprising:

a snowboard boot having a sole portion, a front catch portion located at a front part of said sole portion, a first rear catch portion located at a first lateral side of said sole portion and a second rear catch portion located at a second lateral side of said sole portion; and a snowboard binding configured to be releasably coupled to said snowboard boot, said snowboard binding including a base member including a base elate adapted to be coupled to a top surface of a snowboard and first and second side attachment portions extending upwardly from said base plate, said base elate having a front portion, a rear portion and a longitudinal axis extending between said front and rear portions, said first and second side attachment portions being located at said rear portion;

a front binding member movably coupled to said front portion of said base member between a release position and a latched position to selectively hold said front catch portion;

a first rear binding member coupled to said first side attachment portion at a first lateral side of said rear portion of said base elate to extend inwardly toward said longitudinal axis into a snowboard boot receiving area above said base plate, said first rear binding member including a first latch member movable relative to said base member to selectively hold said first rear catch portion of said snowboard boot; and a second rear binding member coupled to said second side attachment portion at a second lateral side of said rear portion of said base plate to extend inwardly toward said longitudinal axis into said snowboard boot receiving area above said base plate, said second rear binding member including a second latch member movable relative to said base member to selectively hold said second rear catch portion of said snowboard boot, said first and second latch members being arranged to move downwardly toward said base member and laterally away from each other and away from said longitudinal axis upon application of a force on said first and second latch members in a direction substantially towards said base member by said snowboard boot, and to move upwardly away from said base member and laterally inwardly upon removal of said force, said first and second rear binding members being configured and arranged without lever portions that extend away from said first and second longitudinal axes out of said boot receiving area beyond said first and second side attachment portions to release said first and second rear binding members, respectively.

19. A snowboard binding system according to claim 18, wherein said first and second latch members are normally urged to first and second initial positions by first and second biasing members, respectively.

20. A snowboard binding system according to claim 19, wherein said first latch member is pivotally supported about a first pivot axis, and said second latch member is pivotally supported about a second pivot axis.

21. A snowboard binding system according to claim 20, wherein said first and second pivot axes are arranged substantially parallel to said longitudinal axis of said base member.

22. A snowboard binding system according to claim 21, wherein said first and second latch members have first and second elongated locking surfaces, respectively, that are arranged substantially parallel to said longitudinal axis of said base member.

23. A snowboard binding system according to claim 21, wherein said first and second latch members have first and second elongated locking surfaces, respectively, that diverge relative to said longitudinal axis of said base member as said first and second elongated locking surfaces extend from said rear portion of said base member towards said front portion of said base member.

24. A snowboard binding system according to claim 20, wherein said first and second pivot axes diverge relative to said longitudinal axis of said base member as said first and second pivot axes extend from said rear portion of said base member towards said front portion of said base member.

25. A snowboard binding system according to claim 24, wherein said first and second latch members have first and second elongated locking surfaces, respectively, that are arranged substantially parallel to said first and second pivot axes, respectively, such that said first and second elongated locking surfaces diverge relative to said longitudinal axis of said base member as said first and second elongated locking surfaces extend from said rear portion of said base member towards said front portion of said base member.

26. A snowboard binding system according to claim 18, wherein said first and second latch members are first and second pawls that are normally urged by first and second biasing members from first and second guide positions to first and second locking positions, respectively, said first pawl includes a first locking surface and a first guide surface, said second pawl includes a second locking surface and a second guide surface.

27. A snowboard binding system according to claim 26, wherein said first pawl is pivotally supported about a first pivot axis, and said second pawl is pivotally supported about a second pivot axis.

28. A snowboard binding system according to claim 27, wherein said base plate includes a mounting portion with said side attachment portions extending perpendicularly from said mounting portion.

29. A snowboard binding system according to claim 28, wherein said base member further includes a highback support extending upwardly relative to said rear portion of said base member.

30. A snowboard binding system according to claim 29, wherein said first and second pivot axes are arranged substantially parallel to said longitudinal axis of said base plate.

31. A snowboard binding system according to claim 30, wherein said front binding member includes a front pawl urged to said latched position by a front biasing member that applies an urging force on said front pawl, and a release lever coupled to said front pawl to move said front pawl from said latched position to said release position upon application of a force on said release lever that is greater said urging force of said front biasing member.

32. A snowboard binding system according to claim 18, wherein said first latch member is arranged to hold said first rear catch portion at a plurality of different heights relative to said base member; and said second latch member is arranged to hold said second rear catch portion at a plurality of different heights relative to said base member.

33. A snowboard binding system comprising:

a snowboard hoot having a sole portion, a front catch portion located at a front part of said sole portion, a first rear catch portion located at a first lateral side of said sole portion and a second rear catch portion located at a second lateral side of said sole portion, said first rear catch portion including a plurality of first notches and said second rear catch portion including a plurality of second notches; and a snowboard binding configured to be releasably coupled to said snowboard boot, said snowboard binding including a base member having a front portion, a rear portion and a longitudinal axis extending between said front and rear portions;

a front binding member movably coupled to said front portion of said base member between a release position and a latched position to selectively hold said front catch portion;

a first rear binding member coupled to a first lateral side of said rear portion of said base member, said first rear binding member including a first latch member movable relative to said base member to selectively hold said first rear catch portion of said snowboard boot, said first latch member being arranged to hold said first rear catch portion at a plurality of different heights relative to said base member; and a second rear binding member coupled to a second lateral side of said rear portion of said base member, said second rear binding member including a second latch member movable relative to said base member to selectively hold said second rear catch portion of said snowboard boot, said second latch member being arranged to hold said second rear catch portion at a plurality of different heights relative to said base member, said first and second latch members being arranged to move downwardly toward said base member and laterally away from each other and away from said longitudinal axis upon application of a force on said first and second latch members in a direction substantially towards said base member by said snowboard boot.

34. A snowboard binding system according to claim 33, wherein said first notches are located at a first lateral side of said snowboard boot; and said second notches are located at a second lateral side of said snowboard boot such that said second notches face in a substantially opposite direction from said first notches.

35. A snowboard binding system according to claim 34, wherein said first notches are elongated in a direction substantially parallel to said longitudinal axis of said base member; and said second notches are elongated in a direction substantially parallel to said longitudinal axis of said base member.

36. A snowboard binding system according to claim 18, wherein said front binding member is longitudinally adjustable relative to said front portion of said base member such that said front binding member can be selectively coupled at different longitudinal positions relative to said base member.

37. A snowboard binding system according to claim 36, wherein said first and second rear binding members are longitudinally adjustable relative to said rear portion of said base member such that said first and second rear binding members can be selectively coupled at different longitudinal positions relative to said base member.

38. A snowboard binding system according to claim 18, wherein said first and second rear binding members are longitudinally adjustable relative to said rear portion of said base member such that said first and second rear binding members can be selectively coupled at different longitudinal positions relative to said base member.

39. A snowboard binding system according to claim 18, wherein said first and second side attachment portions have first and second support members that are slanted upwardly and outwardly relative to said base plate, respectively.

40. A snowboard binding system according to claim 39, wherein said support members are part of a heel cup with a highback support mounted thereto.

41. A snowboard binding system, comprising:

a snowboard boot having a sole portion, a front catch portion located at a front part of said sole portion, a first rear catch portion located at a first lateral side of said sole portion and a second rear catch portion located at a second lateral side of said sole portion, said first rear catch portion including a pair of substantially parallel first notches located at different heights relative to each other and said second rear catch portion including a pair of substantially parallel second notches located at different heights relative to each other; and a snowboard binding configured to be releasably coupled to said snowboard boot, said snowboard binding including a base member having a front portion, a rear portion and a longitudinal axis extending between said front and rear portions;

a front binding member movably coupled to said front portion of said base member between a release position and a latched position to selectively hold said front catch portion;

a first rear binding member coupled to a first lateral side of said rear portion of said base member, said first rear binding member including a first latch member movable relative to said base member to selectively engage said first rear catch of said snowboard boot; and a second rear binding member coupled to a second lateral side of said rear portion of said base member, said second rear binding member including a second latch member movable relative to said base member to selectively engage said second rear catch of said snowboard boot, said first and second latch members being arranged to initially move laterally apart relative to each other to guide positions upon application of a force on said first and second latch members in a direction substantially towards said base member by said snowboard boot, said first and second latch members being further arranged to subsequently move laterally towards each other to locked positions upon removal of said force such that said first and second latch members engage one of said first notches and one of said second notches, respectively, when in said locked positions, said first latch being engagable within each of said first notches and said second latch being engagable within each of said second notches to selectively couple said snowboard boot to said snowboard binding at two predetermined heights relative to said snowboard binding.

42. The snowboard binding system according to claim 18, wherein said first and second latch members and said first and second rear catch portions are configured to allow forward longitudinal movement of said snowboard boot relative to said first and second latch members when said first and second latch members are holding said first and second rear catch portions respectively, and said front binding member and said front catch portion are configured to limit longitudinal movement of said front catch portion in a forward direction along said longitudinal axis when said front binding member is in said latched position holding said front catch portion.

43. A snowboard binding according to claim 1, further comprising a front binding member movably coupled to said front portion of said base member between a release position and a latched position.

* * * * *